US008561515B1

(12) United States Patent
Bitar et al.

(10) Patent No.: US 8,561,515 B1
(45) Date of Patent: Oct. 22, 2013

(54) METHOD FOR NEUTRALIZING EXPLOSIVES AND ELECTRONICS

(71) Applicant: Xtreme ADS Limited, Anderson, IN (US)

(72) Inventors: Peter V. Bitar, Anderson, IN (US); Rick Lee Busby, Pendleton, IN (US); Leroy Ernest Lakey, Anderson, IN (US); Varce Eron Howe, Zionsville, IN (US)

(73) Assignee: Xtreme ADS Limited, Anderson, IN (US)

( * ) Notice: Subject to any disclaimer, the term of this patent is extended or adjusted under 35 U.S.C. 154(b) by 0 days.

(21) Appl. No.: 13/721,974

(22) Filed: Dec. 20, 2012

Related U.S. Application Data

(60) Continuation of application No. 13/276,502, filed on Oct. 19, 2011, now abandoned, which is a division of application No. 13/155,439, filed on Jun. 8, 2011, now abandoned, which is a division of application No. 12/855,811, filed on Aug. 13, 2010, now Pat. No. 7,958,809, which is a division of application No. 12/030,144, filed on Feb. 12, 2008, now Pat. No. 7,775,146, which is a continuation-in-part of application No. 11/832,952, filed on Aug. 2, 2007, now Pat. No. 7,775,145.

(60) Provisional application No. 60/821,154, filed on Aug. 2, 2006, provisional application No. 60/889,462, filed on Feb. 12, 2007, provisional application No. 60/971,342, filed on Sep. 11, 2007.

(51) Int. Cl.
*F42B 33/06* (2006.01)

(52) U.S. Cl.
USPC ..... 89/1.13; 102/403; 86/50

(58) Field of Classification Search
USPC ..... 89/1.13; 102/402–403; 86/50
See application file for complete search history.

(56) References Cited

U.S. PATENT DOCUMENTS

| | | | |
|---|---|---|---|
| 676,583 | A | 6/1901 | Kinraide |
| 2,378,440 | A | 6/1945 | Scott |
| 2,549,533 | A | 4/1951 | Sevold |
| 2,659,882 | A | 11/1953 | Barrett |
| 2,974,216 | A | 3/1961 | Kiyoshi Inoue |
| 3,601,054 | A | 8/1971 | Christianson |
| 3,663,787 | A | 5/1972 | Haswell, III et al. |

(Continued)

FOREIGN PATENT DOCUMENTS

| | | |
|---|---|---|
| GB | 2122553 | 12/2006 |
| JP | 2001/135451 | 5/2001 |

(Continued)

OTHER PUBLICATIONS

Graham L. Hearn, Static Electricity, Guidance for Plant Engineers, Internet Article (2002) available at http://www.wolfsonelectrostatics.com/01_hazards/pdfs/guidanceforplantengineers-staticelectricity.pdf.

(Continued)

*Primary Examiner* — Michael David
(74) *Attorney, Agent, or Firm* — Woodard, Emhardt, Moriarty, McNett & Henry LLP

(57) ABSTRACT

Disclosed is a system for detonating a buried explosive device by discharging an electric discharge with at least five joules of energy to detonate the buried explosive device.

20 Claims, 21 Drawing Sheets

(56) References Cited

U.S. PATENT DOCUMENTS

| | | | |
|---|---|---|---|
| 3,905,272 | A | 9/1975 | Johnson |
| 4,148,321 | A | 4/1979 | Wyss et al. |
| 4,223,279 | A | 9/1980 | Bradford, Jr. et al. |
| 4,380,958 | A | 4/1983 | Betts |
| 4,401,875 | A | 8/1983 | Schlienger et al. |
| 4,793,325 | A | 12/1988 | Cadossi et al. |
| 4,911,686 | A | 3/1990 | Thaler |
| 4,961,181 | A | 10/1990 | Elliott |
| 4,967,048 | A | 10/1990 | Langston |
| 5,001,485 | A | 3/1991 | Jones |
| 5,007,346 | A | 4/1991 | Kirkland |
| 5,063,850 | A | 11/1991 | Olsson et al. |
| 5,079,482 | A | 1/1992 | Villecco et al. |
| 5,108,247 | A | 4/1992 | Vlaanderen |
| 5,323,726 | A | 6/1994 | Olsson |
| 5,458,063 | A | 10/1995 | Laine et al. |
| 5,592,170 | A | 1/1997 | Price et al. |
| 5,668,342 | A | 9/1997 | Discher |
| 5,675,103 | A | 10/1997 | Herr |
| 5,856,629 | A | 1/1999 | Grosch et al. |
| 5,908,444 | A | 6/1999 | Azure |
| 5,935,460 | A | 8/1999 | Mori et al. |
| 5,982,180 | A | 11/1999 | Bushman |
| 6,163,242 | A | 12/2000 | Crewson et al. |
| 6,254,764 | B1 | 7/2001 | Babington et al. |
| 6,411,095 | B1 | 6/2002 | Chin et al. |
| 6,486,577 | B1 | 11/2002 | Ursel et al. |
| 6,606,932 | B2 | 8/2003 | Goldstein |
| 6,749,389 | B1 | 6/2004 | Vlaanderen |
| 6,799,499 | B2 | 10/2004 | Seregelyi et al. |
| 6,822,250 | B2 | 11/2004 | Korenev |
| 6,825,792 | B1 | 11/2004 | Letovsky |
| 6,913,183 | B2 | 7/2005 | Becker et al. |
| 7,034,539 | B2 | 4/2006 | Ueda et al. |
| 7,051,636 | B1 | 5/2006 | Snow et al. |
| 7,061,636 | B2 | 6/2006 | Ryan et al. |
| 7,109,718 | B2 | 9/2006 | Shimizu et al. |
| 7,130,624 | B1 | 10/2006 | Jackson et al. |
| 7,296,503 | B1 | 11/2007 | McGrath |
| 7,511,654 | B1 | 3/2009 | Goldman et al. |
| 7,775,146 | B1 | 8/2010 | Bitar et al. |
| 7,958,809 | B1 * | 6/2011 | Bitar et al. ..... 89/1.13 |
| 7,987,760 | B1 | 8/2011 | Lundquist et al. |
| 2004/0200341 | A1 | 10/2004 | Walters et al. |
| 2006/0278069 | A1 | 12/2006 | Ryan |
| 2008/0028921 | A1 | 2/2008 | Bitar et al. |
| 2008/0156219 | A1 | 7/2008 | Voss et al. |
| 2011/0120290 | A1 * | 5/2011 | Bitar et al. ..... 86/50 |

FOREIGN PATENT DOCUMENTS

| | | |
|---|---|---|
| JP | 2002/156460 | 5/2002 |
| JP | 2002/020206 | 1/2003 |
| JP | 2002/203744 | 7/2003 |
| JP | 2007/003100 | 1/2007 |
| JP | 2007/108084 | 4/2007 |
| WO | WO 98/36235 | 8/1998 |

OTHER PUBLICATIONS

Haase, Heinz; Electrostatic Hazards, Their Evaluation and control, Verlag Chemie-Weinheim-New York (1977), pp. Preface, Contents, Introduction and 7. Appendix, pp. 108-111.

http://crohmiq.com/mie-fibc-minimum-ignition-energy-antistatic-big-bags.html.

http://www.teledynerisi.com/products/0products_8td_page02.asp.

Office Action dated Jan. 31, 2012 received in re-examination U.S. Appl. No. 95/001,828.

Office Action dated May 23, 2012 received in re-examination U.S. Appl. No. 95/001,828.

Office Action dated Aug. 28, 2012 received in re-examination U.S. Appl. No. 95/001,828.

Terry R. Gibbs, John F. Baytos, LASL Explosive Property Data, University of California Press (1980) pp. 460-461 available at Google Books.

* cited by examiner

METHOD FOR NEUTRALIZING EXPLOSIVES AND ELECTRONICS

BACKGROUND

The present disclosure is related to a system and method for neutralizing explosives and electronics with high voltage electrical discharge.

Disclosed herein is a system and method for providing a mobile means to produce a high voltage electric discharge capable of disabling or destroying electric devices and/or initiating detonation of an explosive device. For example, such an electric discharge can be used to detonate hidden explosive devices such as improvised explosive devices or commercially produced land mines that may be hidden or otherwise obscured from an observer.

High explosives generally used in such explosive devices can be subdivided into classes by their relative sensitivity to heat and pressure as follows. The most sensitive type of explosives are commonly referred to as primary explosives. Primary explosives are extremely sensitive to mechanical shock, friction and heat to which they respond by rapid burning and/or detonation. The term "detonation" is used to describe an explosive phenomenon whereby chemical decomposition of an explosive is propagated by an explosive shock wave traversing the explosive material at great speeds typically thousands of meters per second. Secondary explosives, also referred to as base explosives, are comparatively insensitive to shock, pressure, friction and heat. Secondary explosives may burn when exposed to heat or flame in small unconfined quantities but when confined detonation can occur. To ignite detonation, secondary explosives generally require substantial greater heat and/or pressure. In many applications, comparatively small amounts of primary explosives are used to initiate detonation of secondary explosives. Examples of secondary explosives include dynamite, plastic explosives, TNT, RDX, PENT, HMX and others. A third category of high explosives referred to herein as tertiary explosives, are so insensitive to pressure and heat that they cannot be reliably detonated by practical quantities of primary explosives and instead require an intermediate explosive booster of a secondary explosive to cause detonation. Examples of tertiary explosives include ammonia nitrate fuel mixtures and slurry or wet bag explosives. Tertiary explosives are commercially used in large scale mining and construction operations and are also used in improvised explosive devices (IED) due to their relative ease of manufacture from commercially available components (fertilizer and fuel oil).

Explosive devices, including IEDs, generally contain an explosive charge which could be comprised of either a secondary or tertiary explosive (in devices where a tertiary explosive is used, an additional booster charge of a secondary explosive is often found as well), a detonator (which generally includes a primary explosive and possibly a secondary explosive), and an initiation system to trigger the detonation of the detonator. Initiation systems commonly utilize an electric charge to generate heat through resistance to heat the primary explosive sufficiently to initiate detonation.

A common example of a detonator is a blasting cap. There are several different types of blasting caps. One basic form utilizes a lit fuse that is inserted in a metal cylinder that contains a pyrotechnic ignition mix of primary explosive and an output explosive. The heat from a lit fuse ignites the pyrotechnic ignition mix which subsequently detonates the primary explosive which then detonates the output explosive that contains sufficient energy to trigger the detonation of a secondary explosive as described above.

Another type of blasting cap uses electrical energy delivered through a fuse wire to initiate detonation. Heat is generated by passing electrical current through the fuse wire to a bridge wire, foil, or electric match located in the blasting cap. The bridge wire, foil or electric match may be located either adjacent to a primary explosive or, in other examples, the bridge wire, foil or electric match may be coated in an ignition material with a pyrotechnic ignition mix located in close proximity to detonate a primary explosive, which, as described above, detonates an output explosive to trigger detonation of the explosive device. Electric current can be supplied with an apparatus as simple as connecting the fuse wire to a battery or an electric current can be supplied by an initiation system that includes a triggering control such as a remote signal or a timer.

Mines and IEDs are extremely diverse in design and may contain many types of initiators, detonators, penetrators and explosive loads. Anti-personnel IEDs and mines typically contain shrapnel generating objects such as nails or ball bearings. IEDs and mines are designed for use against armor targets such as personnel carriers or tanks which generally include armor penetrators such as a copper rod or cone that is propelled by a shaped explosive load. Mines and IEDs are triggered by various methods including but not limited to remote control, infrared or magnetic triggers, pressure sensitive bars or trip wires and command wires.

Military and law enforcement personnel from around the world have developed a number of procedures to deal with mines and IEDs. For example, a remote jamming system has been used to temporarily disable a remote detonation system. In some cases it is believed that the claimed effectiveness of such remote jamming systems, proven or otherwise has caused IED technology to regress to direct command wire because physical connection between the detonator and explosive device cannot be jammed. However, in other situations it has been found that jamming equipment may only be partially effective because they may not be set to operate within the correct frequency range in order to stop a particular IED. Much of the radio frequency spectrum is unmanaged and in other cases jamming of some portions of the radio frequency spectrum can dangerously interfere with other necessary radio communications.

Other known methods of dealing with mines and IEDs include the use of mine rollers to detonate pressure sensitive devices. High powered lasers have been used to detonate or burn the explosives in the mine or IED once the mine or IED is identified. Visual detection of the mine or IED and/or alterations to the terrain that were made in placing the mine or IED are some of the current methods used to combat such explosive devices.

DETAILED DESCRIPTION OF THE DRAWINGS

Figure 1:
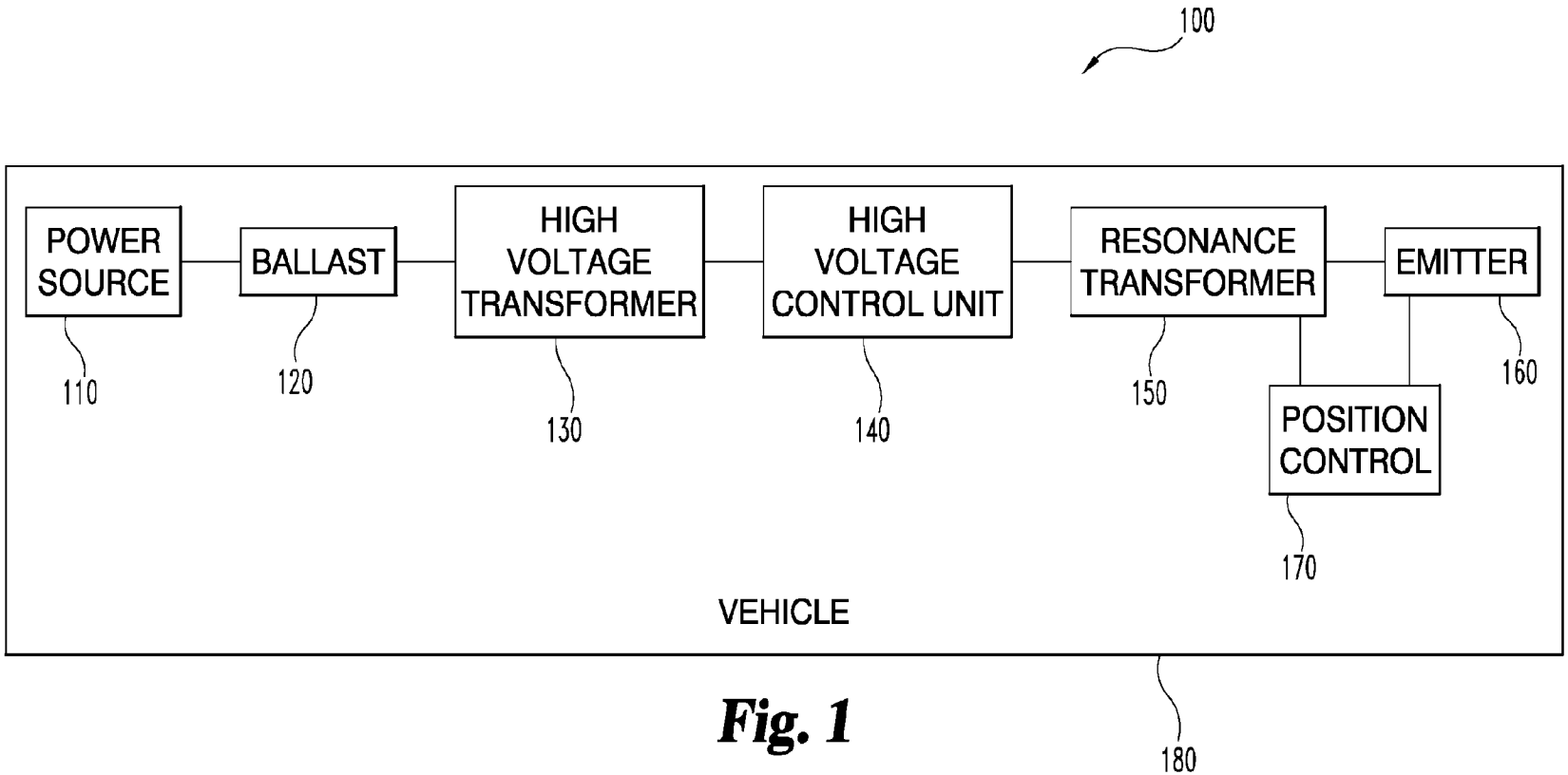
FIG. 1 is a block diagram of system 100.

For the purpose of promoting an understanding of the disclosure, reference will now be made to certain embodiments thereof and specific language will be used to describe the same. It will nevertheless be understood that no limitation of the scope of this disclosure is thereby intended, such alterations, further modifications and further applications of the principles described herein being contemplated as would normally occur to one skilled in the art to which the disclosure relates. In several figures, where there are the same or similar elements, those elements are designated with similar reference numerals.

The systems and methods disclosed herein for generating an electric discharge are capable of identifying, disabling and/or detonating mines and IEDs in several ways. In mines and IEDs utilizing a remote controlled initiated receiver, it is possible for an electric discharge to temporarily disable the initiation receiver from receiving a command signal from its corresponding transmitter. In other cases, any initiation electronics could be outright destroyed by the heat and electrical energy contained in an electric discharge and in yet other examples, sufficient heat or energy may be delivered by an electric discharge to initiate combustion of the primary explosive in a mine or IED, thereby detonating it and destroying the mine or IED. Such destruction preferably occurs a sufficient distance from protected vehicles and personnel to mitigate the potential damaging affect of such an explosion.

Detonation of a mine or IED can be initiated by an electric discharge in several ways. If the mine or IED includes metallic components, such components may attract and conduct an electric discharge. If conduction occurs across a bridgewire, sufficient heat may be generated to initiate detonation by igniting the primary explosive and/or any pyrotechnic ignition mix or electric match material that may be present. Detonation may also occur if sufficient heat is transferred to the primary explosive and/or any pyrotechnic ignition mix or electric match used to detonate the mine or IEDs independently of any fuse wire that may or may not be present.

In this regard, the construction of many mines and IEDs may lend to attracting electric discharges. For example, command wires utilized to control detonation are susceptible to a high voltage charge breaking down any insulation and energizing the command wire (and detonating the device). Other mines and IED may include metallic components, e.g., outer casings, metallic penetrators and/or shrapnel, remote control antenna and other remote control components. Once a high voltage discharge is attracted to a mine or IED, there is a good probability that the discharge will cause detonation.

Turning now to FIG. 1, system 100 is illustrated as a block diagram. System 100 includes power source 110, ballast 120, high voltage transformer 130, high voltage control unit 140, transformer 150, emitter 160, position control 170, and vehicle 180.

In one embodiment, power source 110 could be an AC generator including a single phase, 120 V or 240 V generator or a three-phase generator as known in the art. In various embodiments, power source 110 may operate at 50 or 60 Hz as is typical in many commercially available generators or alternatively can operate at higher frequencies for example 400 Hz, as will be discussed in greater detail herein. Ballast 120 in the illustrated embodiment is a reactive current limiting ballast. Ballast 120 limits the current demand from high voltage transformer 130 to prevent excessive current demand from damaging power source 110 or blowing fuses that are commonly part of power source 110. Ballast 120 may comprise any ballast known in the art including inductive ballasting or resistant ballasting.

In one embodiment, high voltage transformer 130 is a step-up transformer. In a particular embodiment, high voltage transformer 130 is a power distribution transformer wired backwards so that the traditional output side of 240 V is connected to power source 110 while the traditional input side of 14.4 V is the output. The particular configuration of high voltage transformer 130 may dictate whether ballast 120 is utilized. For example, commercially available power distribution transformers are not generally current limited. In embodiments utilizing such transformers, ballast 120 can limit the current draw from power source 110, if so desired. However, other high voltage transformers 130 exist that are current limited. In such embodiments, ballast 120 may be rendered redundant and could optionally be omitted.

Still referring to FIG. 1, one embodiment of high voltage control unit 140 includes a spark gap and a capacitor. In such an embodiment, high voltage control unit 140 operates by building a charge in the capacitor until a sufficient potential is reached to break over the spark gap at which point the potential stored in the capacitor discharges to resonance transformer 150 through the spark gap. As will be described further herein, such a spark gap can be of any type known in the art. In alternative embodiments, a high voltage control unit could comprise solid state switches and controls for such switches as are known in the art.

Still referring to system 100, in one embodiment, resonance transformer 150 is an oudin coil comprising a primary and secondary coil electromagnetically coupled and acting to further increase voltage. Resonance transformer 150 may also include a capacitive dome formed of either a sphere or toroid as are known in the art. Emitter 160 may then be coupled to the capacitive sphere or toroid. Emitter 160 may comprise a rod or hollow tube ending in a rounded, squared or a pointed emitter as will be described in greater detail herein. Emitter 160 can be configured to be stationery with respect to resonance transformer 150 or can be configured to be movable.

Position control 170 is optionally coupled to resonance transformer 150 and/or emitter 160 to permit positioning of emitter 160 as desired. In one embodiment, position control 170 controls a rotation of resonance transformer 150 and angle of emitter 160 permitting adjustment of emitter 160 in three dimensions as will be described in greater detail herein. In an alternative embodiment, resonance transformer 150 and emitter 160 could be independently positionable away from vehicle 180, for example on a tripod or other structure that could be temporarily erected near a point of interest to be interrogated with electrical discharge(s). In such an embodiment, resonance transformer 150 could be coupled to high voltage control unit 140 by a flexible coil of wire to permit locating vehicle 180 and the remaining components an extended distance away from emitter 160. Other embodiments of system 100 may optionally omit position control 170. In such embodiments, emitter 160 could be positioned solely by positioning vehicle 180.

Components of system 100 are carried by vehicle 180. Vehicle 180 may comprise a motorized vehicle such as a car, truck, humvee, tank, mine roller buffalo, remote controlled car or any other vehicle that would be desirable to mount system 100 on to provide mobility. Vehicle 180 may include appropriate armor and/or shielding for anticipated mine and/or improvised explosive device detonations as will be described in greater detail herein. The components of system 100 can be mounted on vehicle 180 in whatever configuration is desired, examples of which are described herein.

Figure 2:
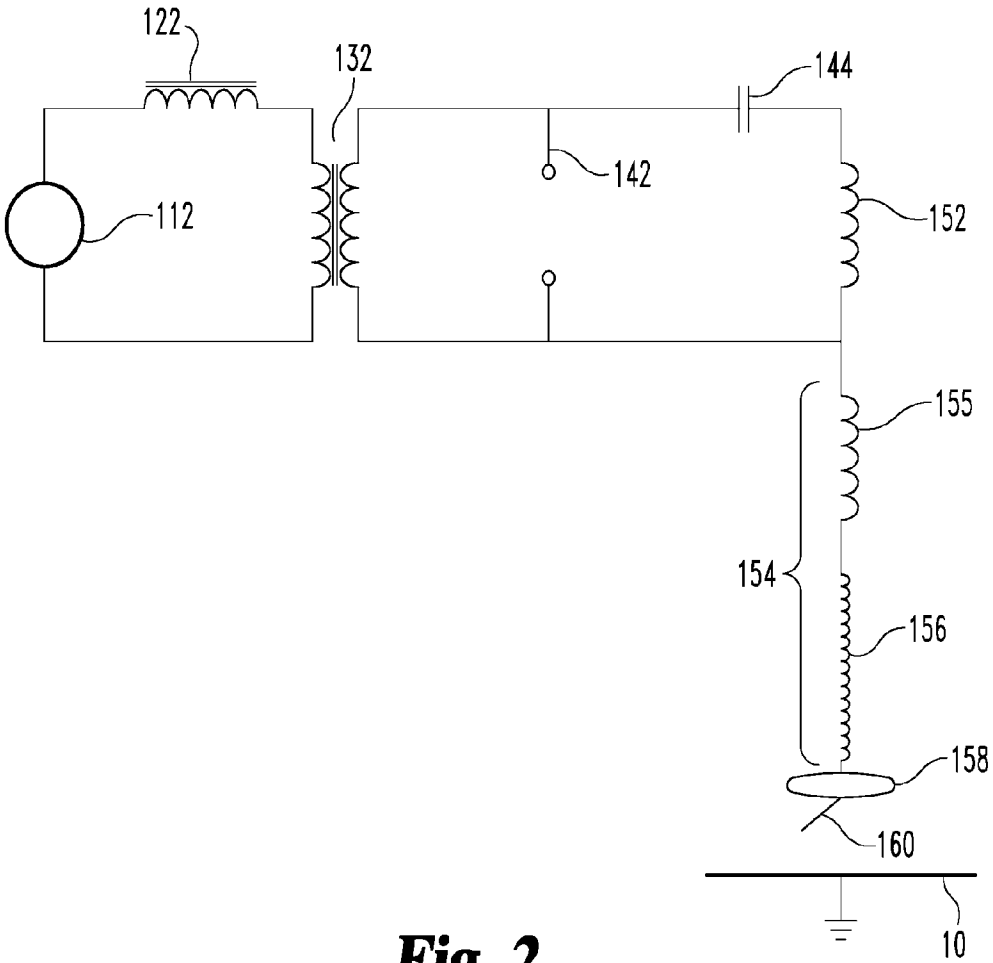
FIG. 2 is a simplified electrical schematic of one embodiment of system 100.

Turning now to FIG. 2, a particular embodiment of system 100 is illustrated in a simplified schematic including AC generator 112, reactive ballast 122, transformer 132, spark gap 142, capacitor 144, primary coil 152, secondary coil 154 comprising magnifier windings 155 and resonator windings 156 coupled to toroidal capacitor 158 and emitter 160. Emitter 160 being positioned over and away from ground 10. The embodiment of system 100 illustrated in FIG. 2 operates as follows. AC generator 112 generates a 240 V alternating current at 60 Hz which is coupled to transformer 132 through reactive ballast 122. Transformer 132 is a standard step down distribution transformer primarily used to convert 14,400 V to standard 240 V such as those used in neighborhood localities. In the illustrated embodiment, this step down distribution transformer is wired backwards so that it becomes a step up transformer such that the 240 V coming from AC generator 112 is increased to 14,400 V. The output of transformer 132 is coupled to primary coil 154 through spark gap 142 and capacitor 144 which operates as follows. Electric potential accumulates in capacitor 144 until sufficient potential is reached to overcome the air gap between the electrodes of spark gap 142 at which point break over occurs and a spark jumps between the electrodes of spark gap 142 and the energy stored in capacitor 144 is released into primary coil 152 through the spark. Primary coil 152 is electromagnetically coupled to secondary coil 154 by magnifier windings 155, resonator windings 156 further multiply the voltage transferred from primary coil 152 to secondary coil 154 to toroidal capacitor 158 where the charge is accumulated until sufficient potential is reached to overcome the air gap between emitter 160 and ground 10 at which point electric discharge occurs between emitter 160 and ground 10. In any event, other embodiments may omit magnifier windings 155.

Figure 3:
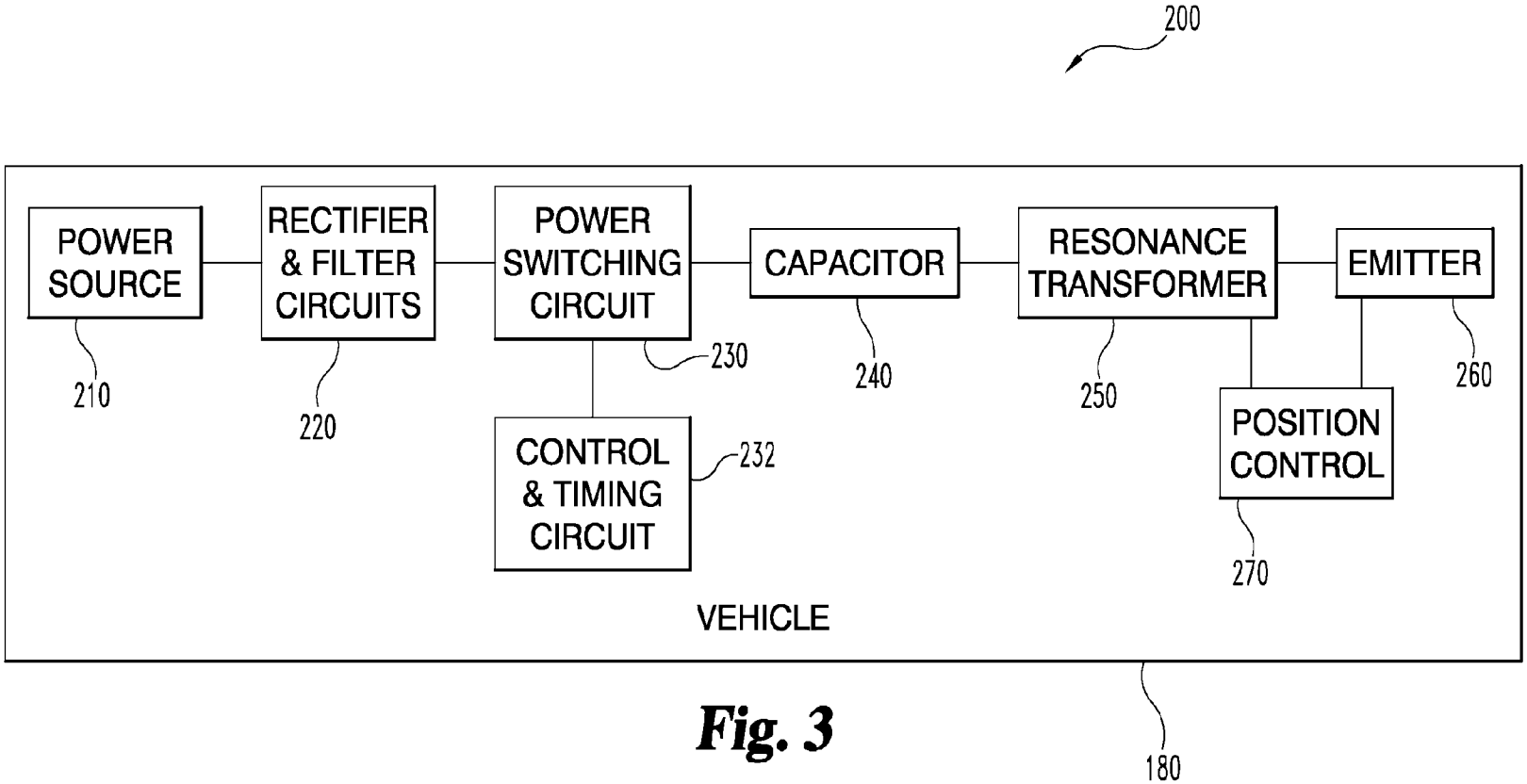
FIG. 3 is a block diagram illustrating system 200.

Turning now to FIG. 3, system 200 is illustrated as a block diagram. System 200 includes power source 210, rectifier and filter circuits 220, power switching circuit 230, control and timing circuits 232, capacitor 240, resonance transformer 250, emitter 260, position control 270 and vehicle 180.

Power source 210 can be any power source known to those skilled in the art including AC or DC generator or any form of battery known to those in the art. In embodiments utilizing an AC power sources such as an AC generator, rectifier and filter circuits 220 function to convert the AC current to a DC current and operate to smooth any ripple on the AC voltage going into the rectifier circuits. In alternative embodiments utilizing DC power sources, rectifier and filter circuits 220 can be omitted.

Still referring to system 200, power switching circuit 230 comprises solid state high voltage switching circuits controlled by timing circuits 232 as is known in the art. The output of power switching circuit 230 is coupled to resonance transformer 250 through capacitor 240. As described above, resonance transformer 250 includes a primary and secondary coil electromagnetically coupled and acting to increase the voltage. Resonance transformer 250 may also include a capacitive dome formed of either a sphere or toroid as is known in the art with emitter 260 coupled to either the capacitive dome or to the secondary coil. Similar to position control 170, position control 270 is optionally coupled to resonance transformer 250 and/or emitter 260 to permit positioning of emitter 260 as desired and in the same way as described above with respect to position control 170. Components of system 200 are carried by vehicle 180 as described above.

Figure 4:
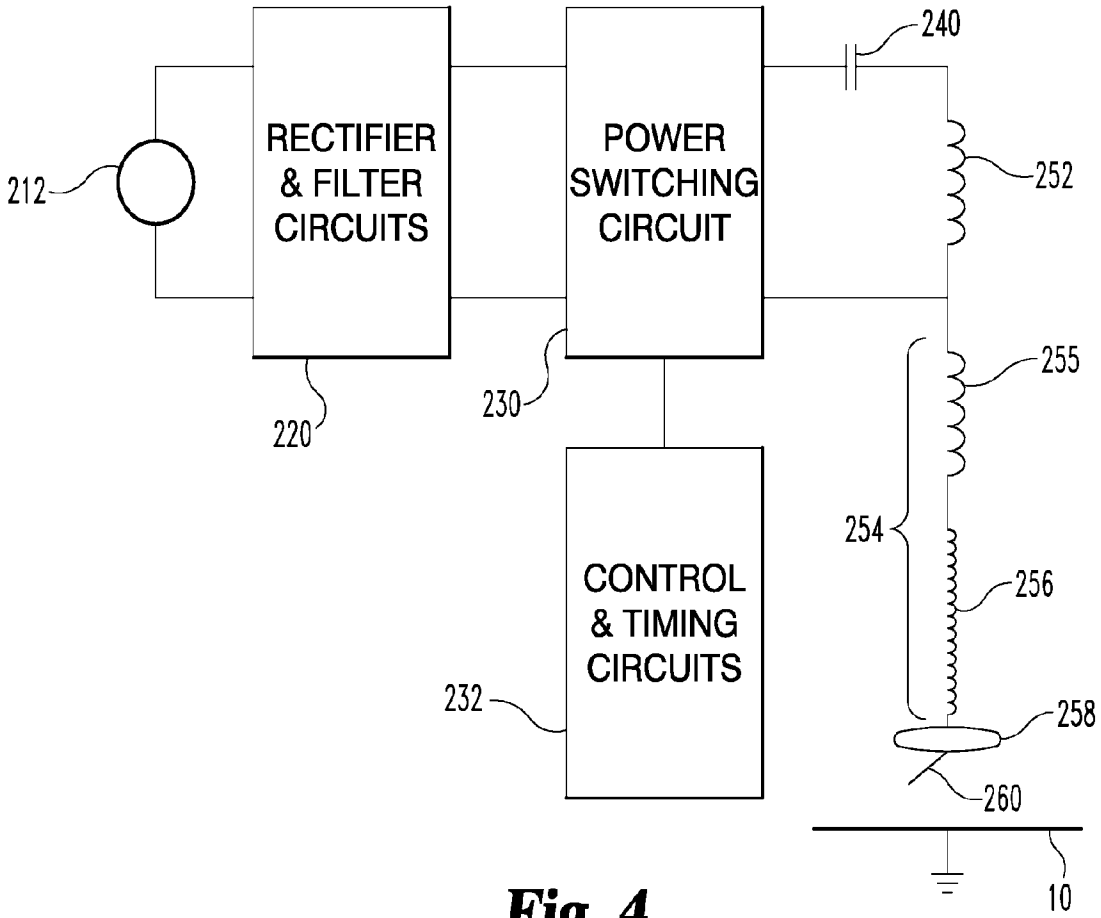
FIG. 4 is a simplified electrical schematic of one embodiment of system 200.

Turning now to FIG. 4, a particular embodiment of system 200 is illustrated with a simplified schematic diagram including AC generator 212, rectifier and filter circuits 220, power switching circuit 230, control and timing circuits 232, capacitor 240, primary coil 252, secondary coil 254 comprising magnifier windings 255 and resonator windings 256 coupled to toroid capacitor 258 and emitter 260 positioned over and away from ground 10. The embodiments of system 200 illustrated in FIG. 4 operates as follows. AC generator 212 generates 240 V alternating current at 60 Hz coupled to rectifier and filter circuits 220 that convert the power to a 350 to 800 V DC current coupled to power switching circuit 230 which is controlled by controlling timing circuits 232 to supply pulsed energy to capacitor 240 and primary coil 252 when the solid state relays in power switching circuit 230 close. When the solid state relays and power switching circuit 230 open, the potential stored in capacitor 240 discharges through primary coil 252 which is electromagnetically coupled to secondary coil 254 by magnifier windings 255 and resonator windings 256 that further multiply the voltage from primary coil 252 to toroidal capacitor where a charge accumulates until sufficient potential is reached to overcome the air gap between emitter 260 and ground 10 at which point an electric discharge occurs between emitter 260 and ground 10.

Figure 5:
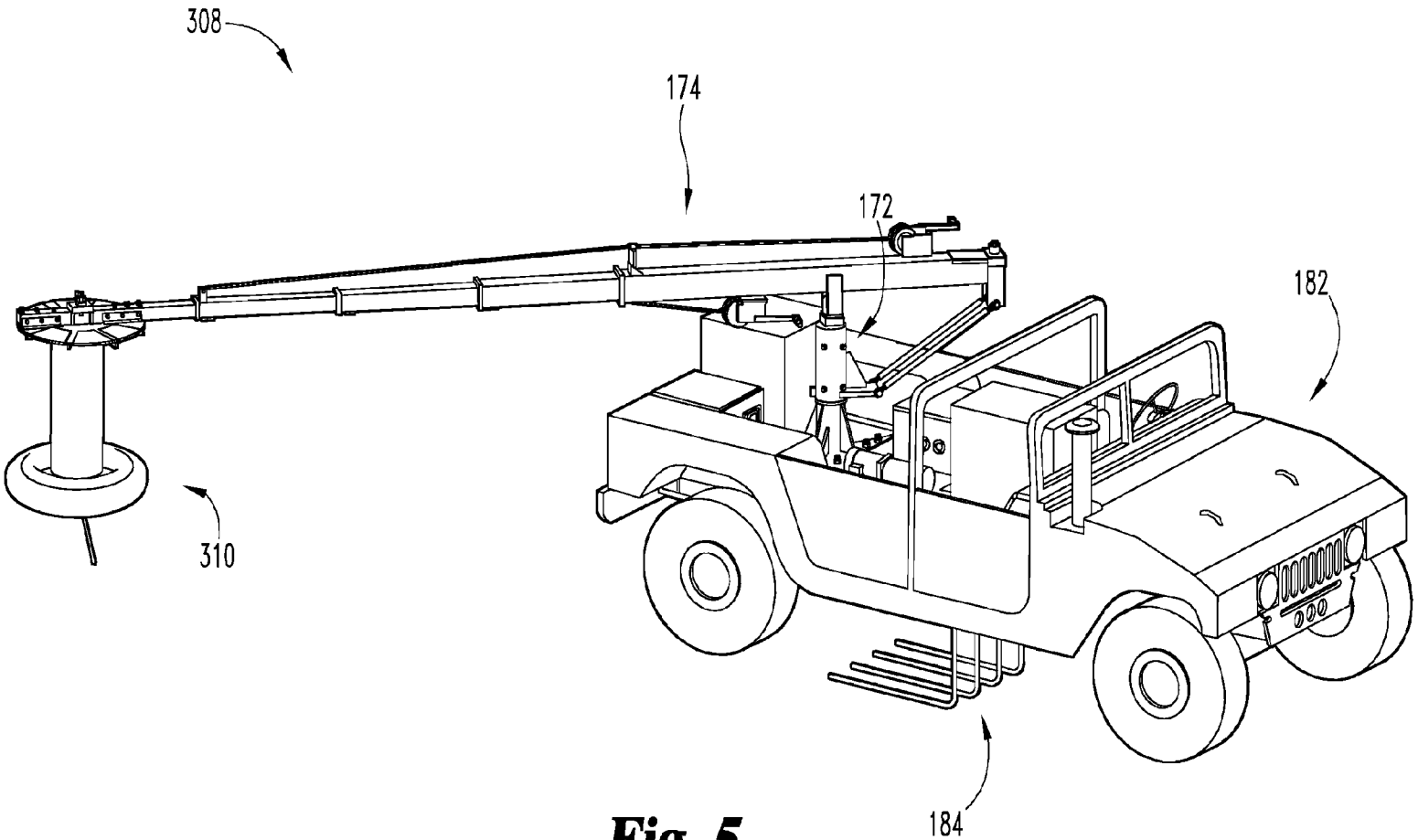
FIG. 5 is an isometric view of system 300.

Turning now to FIG. 5, one embodiment of system 100 is illustrated. It should be understood that while system 100 is illustrated and described, the components of system 200 could be readily substituted by one of ordinary skilled in the art. The embodiment of system 100 illustrated in FIG. 5 includes vehicle 182, pivot 172, boom arm 174, grounding chains 184, and discharge assembly 310. Pivot 172 and boom arm 174 are one embodiment of position control 170. Pivot 172 and boom arm 174 permit positioning of discharge assembly 310 away from vehicle 182 to limit the exposure of vehicle 182 and the systems included thereon from potential effects of both electric discharge from discharge assembly 310 and any resulting detonation that may occur. In the illustrated embodiment, vehicle 182 is a modified humvee 4-wheeled vehicle modified to permit remote control of vehicle 182 and the systems contained thereon to permit an operator to stand off yet a further distance from discharge assembly 310 and any item of interest being interrogated by discharge assembly 310. Grounding assembly 184 provides one route to earth for any potential that may build up on vehicle 182 to prevent a potential hazardous situation from developing where vehicle 182 contains sufficient potential such that a person exiting or entering vehicle 182 could inadvertently create path to ground for the potential stored in vehicle 182 resulting in injury of such an individual.

Discharge assembly 310 may comprise a Tesla Coil, Oudin Coil, Marx generator or any other form of resonance transformer to control and direct the energy discharged to at least one discharge point to produce a desired spark pattern on the ground, which provides maximum desired coverage when sweeping for an explosive device. In other embodiments, non-resonant transfers could be used instead of a resonance transformer. In any event, discharge assembly 310 is illustrated in greater detail in FIGS. 6-8.

Figure 6:
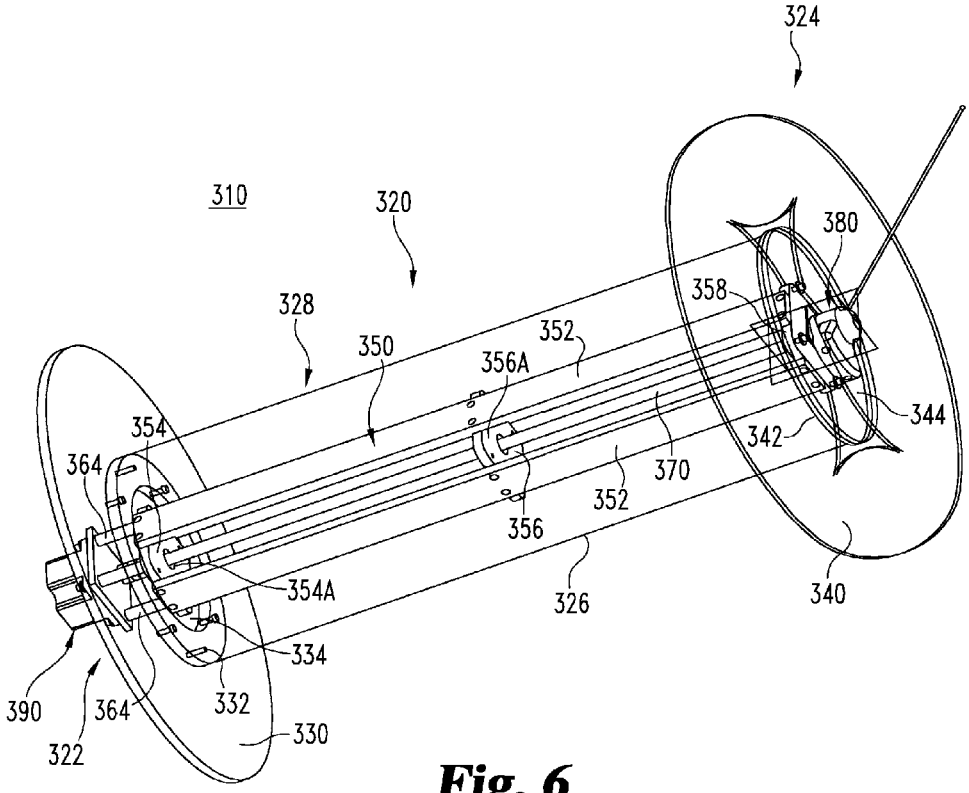
FIG. 6 is an isometric view of one embodiment of a portion of system 300.

As shown in FIG. 6, discharge assembly 310 includes a resonance transformer assembly 320 comprising a first end 322 and a second end 324, operably coupled by core 326 to form a bobbin 328 for receiving coil windings. Primary and secondary coils (not shown) of transformer assembly 320 are wound about hollow cylindrical core 326 of bobbin 328. End 324 includes a movable, e.g., spinning, breakout assembly point 380 that attaches to motor assembly 390 at end 322 via shaft 370.

End 322 includes bobbin plate 330 having bobbin mounting ring 332 and bobbin plate cutout 334. End 324 includes bobbin plate 340 having mounting ring 342 and bobbin plate cutout 344. Bobbin core 326 is formed by attaching bobbin plate 330 at bobbin mounting ring 332 and bobbin plate 340 at mounting ring 332 to bobbin shaft 336.

Transformer assembly 320 further includes shaft support assembly 350 passing through the hollow center of bobbin 328. Shaft support assembly 350 includes shaft supports 352, only two of which are shown, operably coupled to end axle plates 354 and 358, and center axle plate 356.

Axle plates 354, 356, and 358 include axle plate cutouts 354A, 356A, and 358A (not shown), respectively, to allow shaft 370 to pass from end 324 to end 322.

Axle plate 354 receives stand offs 364 for mounting motor assembly 390 to transformer assembly 320. It will be appreciated that axle plate 54 may mount inside bobbin plate cutout 334 or axle plate 354 may mount directly to bobbin plate 330. Similarly, axle plate 358 may mount inside bobbin plate cutout 344 or axle plate 358 may mount directly to bobbin plate 340.

Figure 7:
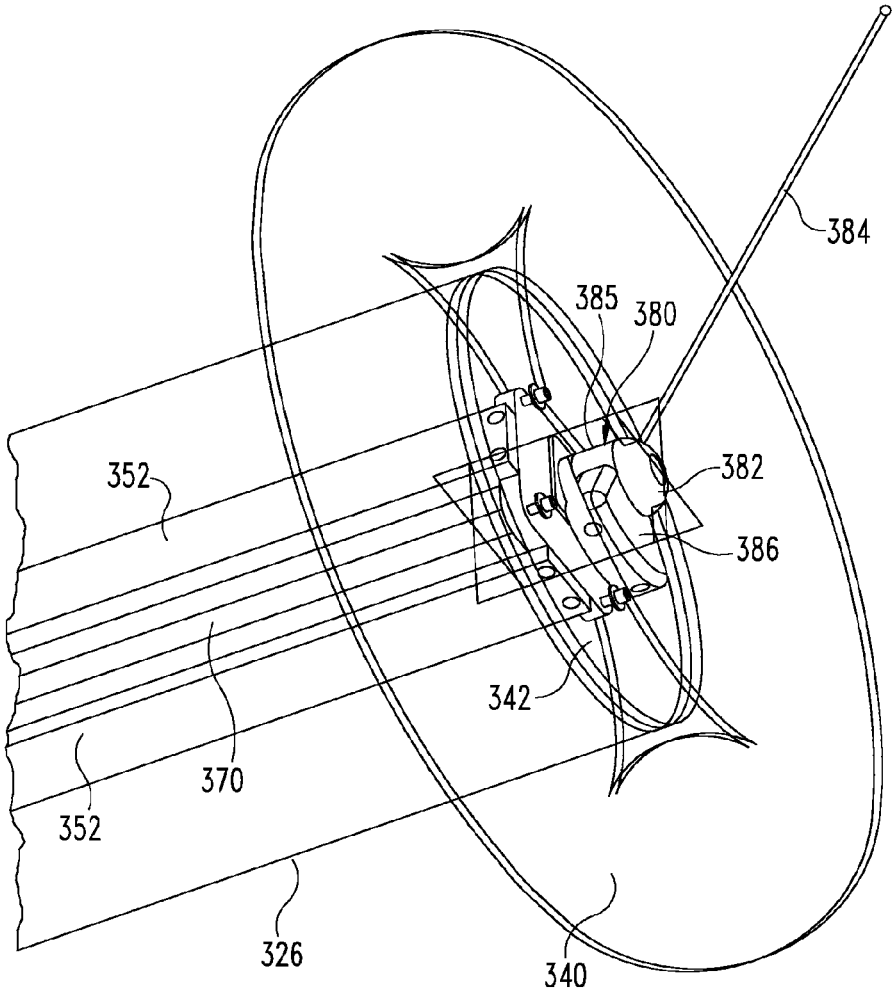
FIG. 7 is an isometric view of one embodiment of a portion of system 300.

As shown in FIG. 7, spinning breakout assembly 380 includes electrode hub 382, electrode 384, and commutator interface 385. Electrode hub 382 operatively couples electrode 384 to shaft 370. Toroidal capacitor 386 mounts to bobbin plate 340, proximate to electrode hub 382. The output of the secondary coil (not shown) of transformer assembly 320 couples to toroidal capacitor 386 and commutator interface 385, such that commutator interface 385 provides a discharge path from the resonant transformer secondary windings to electrode 384. Commutator interface 385 may include a brush or barring assembly to electrically conduct energy from the resonant transformer output to electrode 384. Commutator interface 385 may also comprise a spark gap, which conducts energy after a sufficient breakdown voltage is present at the output of toroidal capacitor 386. Energy is conducted via electrode 384A to a "break-out" or discharge point creating a discharge spark.

Figure 8:
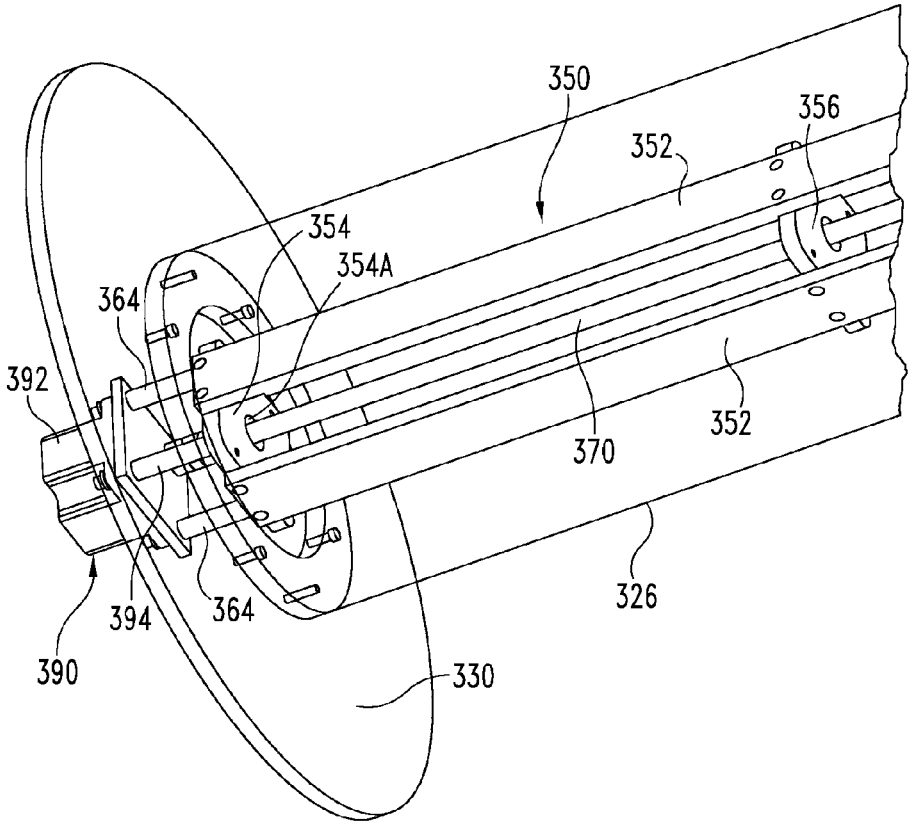
FIG. 8 is an isometric view of one embodiment of a portion of system 300.

As shown in FIG. 8, motor assembly 390 includes motor 392 and motor coupler 394. Shaft 370 passes through axle plate cutout 354A of axle plate 354 and bobbin plate 330 to couple to the shaft of motor 392 via coupler 394. Motor 392 mounts to axle plate 354 via stand offs 364. Motor 392 can be of any type of motor known in the art including, but not limited to, electric, hydraulic, and pneumatic. It will be understood that in some embodiments motor 392 may be directly mounted to bobbin plate 330.

In addition to the structural aspects of transformer assembly 320, materials used to manufacture assembly 320 are selected to minimize the risk of high voltage discharges being conducted into motor 392 or other portions of system 310. Illustratively, at least some components of shaft support assembly 350, shaft 370, and coupler 394 are non-conductive to prevent charge carried through breakout assembly 380 from discharging into motor assembly 90 or other portions of system 310.

Figure 9:
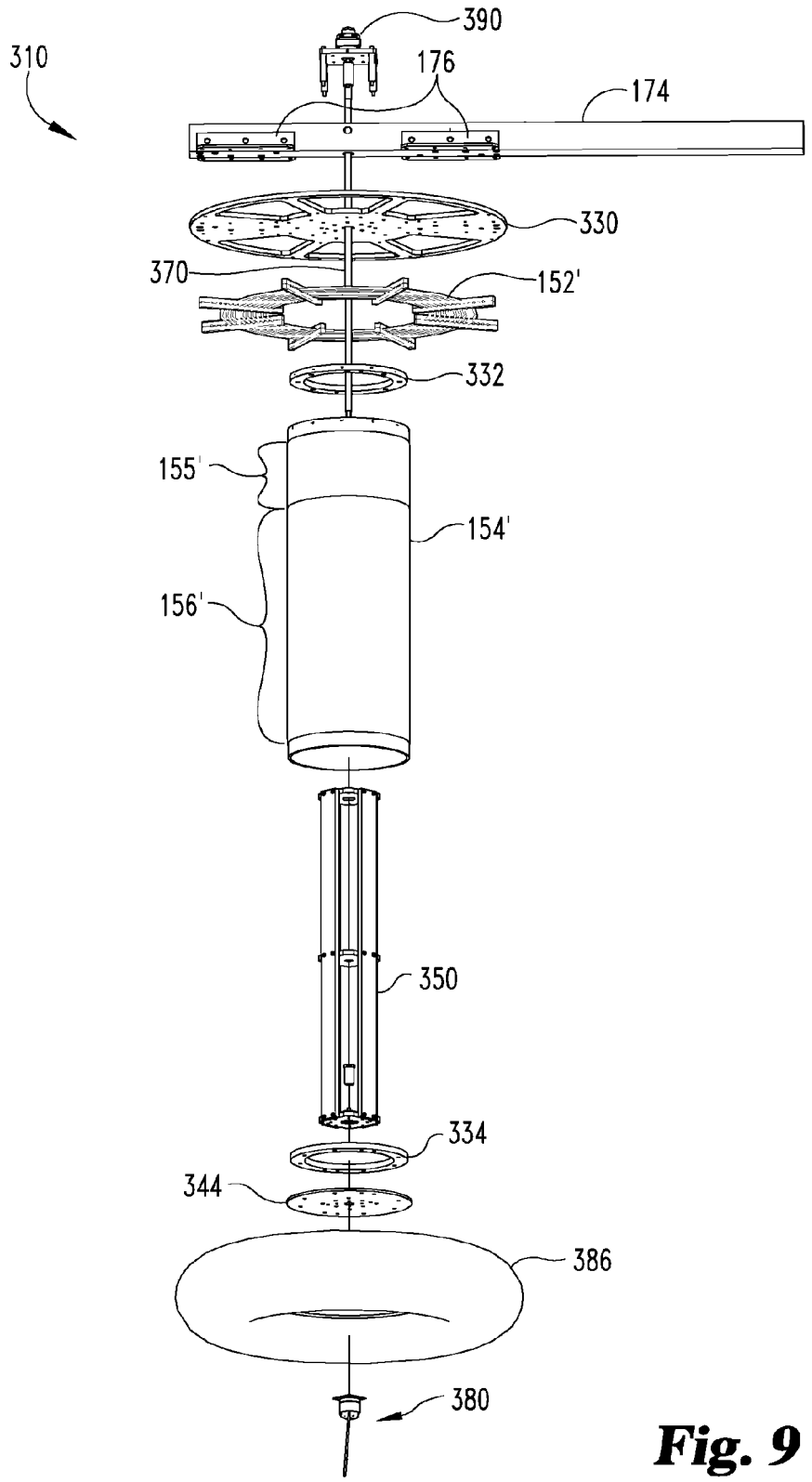
FIG. 9 is an assembly view of one component of one embodiment of system 300.

Turning now to FIG. 9, discharge assembly 310 is illustrated in an exploded view. As illustrated, discharge assembly 310 includes motor assembly 390, boom arm 174, brackets 176, plate 330, shaft 370, primary coil assembly 152, mounting ring 332, secondary coil assembly 154' comprising magnifier windings 155' and resonator windings 156', shaft support assembly 350, mounting ring 334, plate 344, toroidal capacitor 386 and spinning breakout assembly 380. The illustrated embodiments, brackets 176, couple plate 330 to boom arm 174 by a plurality of bolts and shaft 370 couples spinning breakout assembly 380 to motor assembly 390 through the other components of discharge assembly 310. It should be noted that the illustrated comparative size of magnifier windings 155' and resonator windings 156' are for illustrative purposes only. The actual proportion of these two windings to each other is dictated on the relationship between primary coil assembly 152' and secondary coil assembly 154'. In particular, the size and number of windings of primary coil assembly 152 and the size and winding density of secondary coil assembly 154'.

Figure 10:
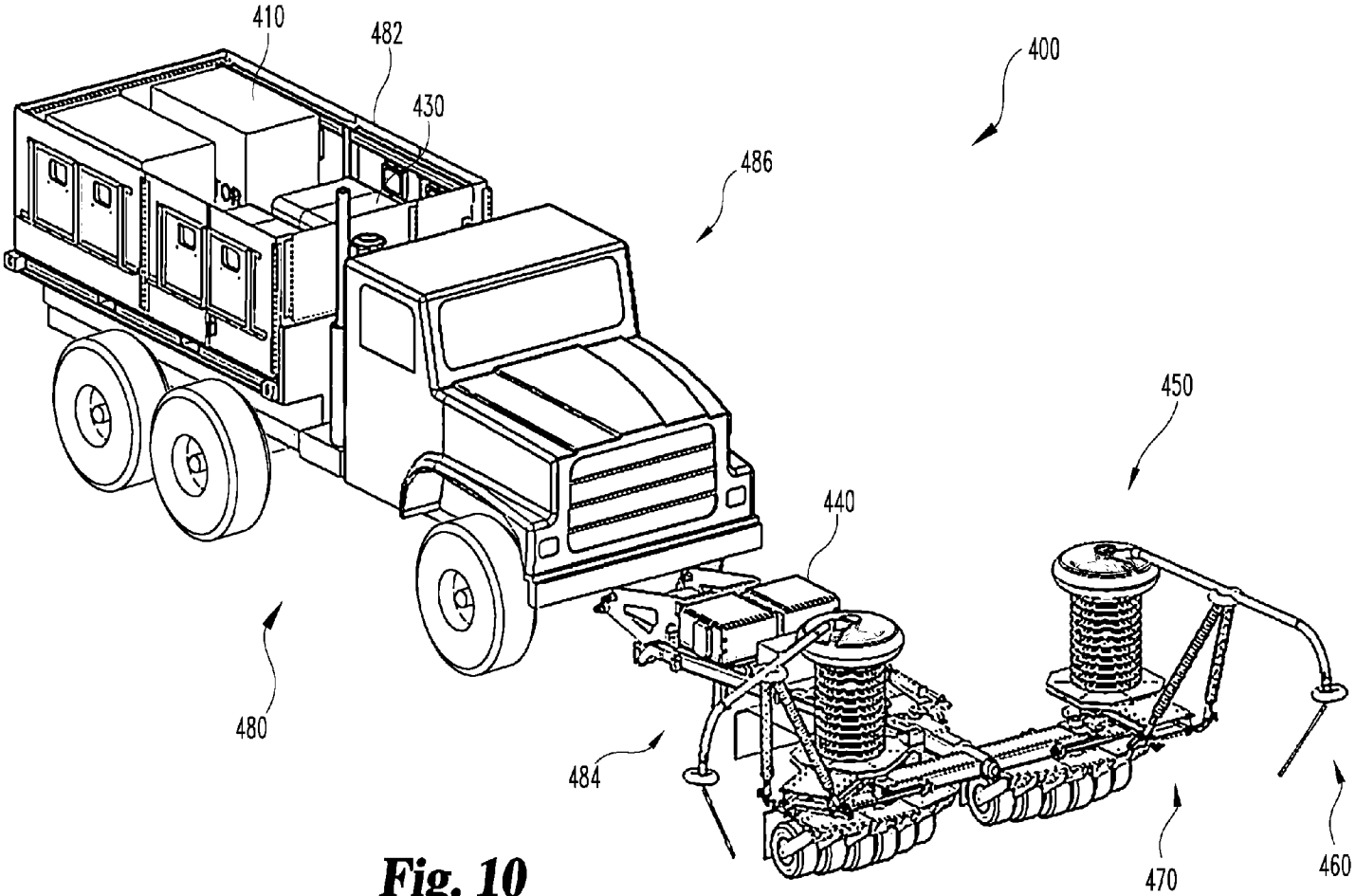
FIG. 10 is an isometric view of system 400.

Turning now to FIG. 10, system 400 is illustrated. System 400 incorporates two separate systems for emitting electric discharges. Each of which independently could conform to systems 100 or 200 described above. System 400 will be described with regard to one system located on the left side of FIG. 10 where it should be understood that a copy of the described system is located on the opposite side of the vehicle and apparatus illustrated on FIG. 10. System 400 includes generator module 410, transformer module 430, control module 440, resonance transformer module 450, emitter module 460, position control module 470, mine roller 480, armored container 482, mine roller assembly 484 and vehicle 486.

Turning now to the individual components illustrated in FIG. 10, it should be understood that many of the components described herein are designed to be modular components that can be individually replaced and upgraded and that the electric discharge system described with respect to FIG. 10 is intended to be added to an existing U.S. Army mine rolling system. As such, each component is independent of the Army mine rolling system. It should be understood that alternate embodiments envision that some or all of the components described herein could be incorporated directly into a vehicle instead of being separable components. In any event, generator module 410 comprises a 240 V AC generator rated at 20 kW contained within an armored module box. Next to generator module 410 is transformer module 430. Transformer module 430 contains power distribution transformer rated at 14.4 kV as described above. This could be a standard power distribution transformer used in power distribution grids. However it is installed backwards from normal wherein the normal output of 240 V is the input and the normal input of 14.4 kV is the output. The high voltage transformer used in control module 430 has been customized to increase mechanical strength of components therein. The transformer is rated at 25 kVa. Generator module 410 and transformer module 430 are contained within armor container 482 which is located on the back bed of vehicle 486. In one embodiment armor container 482 is an armored personnel carrier that has been adapted for use as described herein. While not illustrated in FIG. 10, armored container 482 also contains auxiliary power module 435 as described below.

Mine roller 480 comprises mine roller assembly 484 and vehicle 486. In the illustrated embodiment vehicle 486 is a U.S. Army seven ton rated truck and mine roller assembly 484 is a pre-existing mine roller assembly used by the U.S. Army for mine rolling operations.

As illustrated in FIG. 10, mine roller assembly 484 includes control module 440, resonance transformer module 450, emitter module 460 and position control module 470. Once again, these components are intended to be removable from mine roller assembly 484. However, alternate embodiments are envisioned where these components could be incorporated directly thereon. Control module 440 contains a spark gap unit and a capacitive bank, resonance transformer module 450 includes a primary coil, a secondary coil, and a toroidal capacitor, emitter module 460 includes an extension arm, a toroidal rotor and a emitter probe, and position control module 470 includes rotary adjusters, vertical adjusters coupled to a vertical support and a cradle as will be described in greater detail herein.

Figure 11:
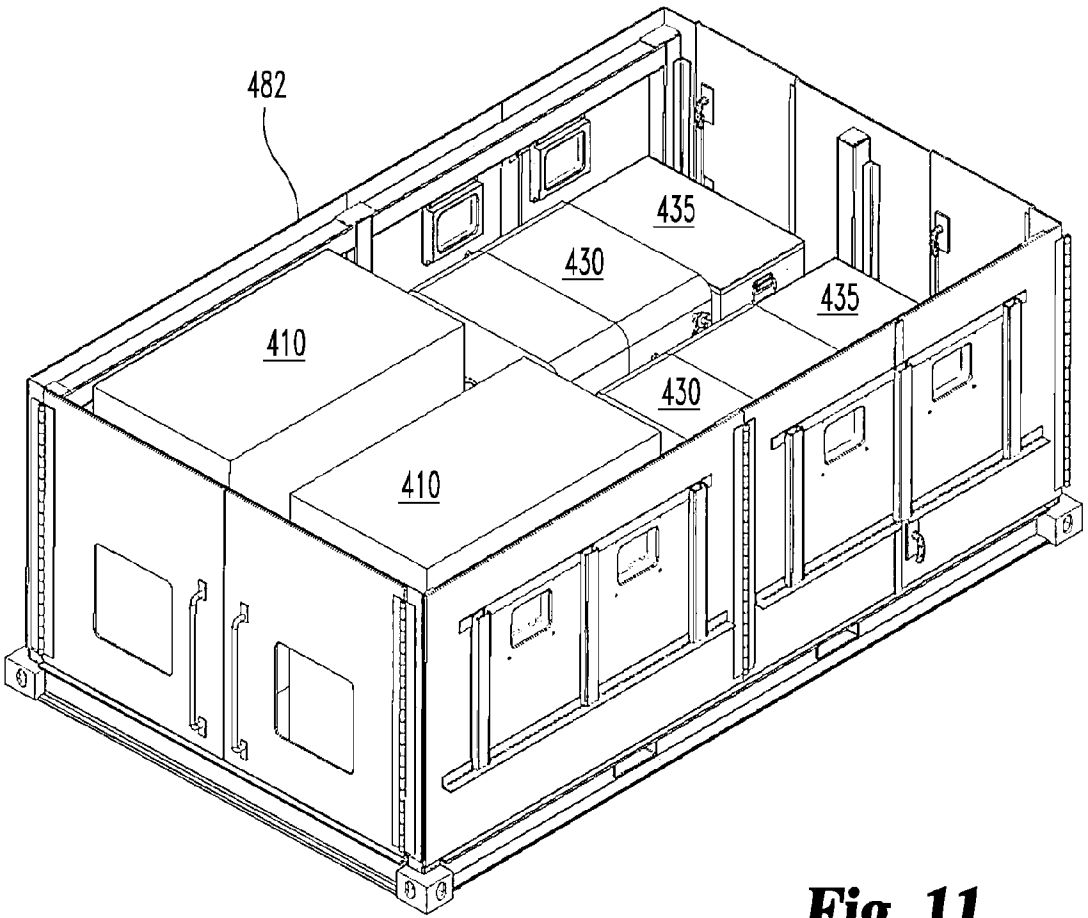
FIG. 11 is an isometric view from a different angle than FIG. 10 of several components of system 400.

Turning now to FIG. 11, an alternate view of the power generation modules of system 400 is illustrated. FIG. 11 includes generator modules 410, transformer modules 430 and auxiliary power modules 435 which are contained in armored container 482 and located on the back of vehicle 486 as illustrated in FIG. 10. Auxiliary power modules 435 each contain a hydraulic pump and blower system for use as will be described in greater detail herein. In other embodiments, the air blower could be replaced with an air compressor and in other embodiments both systems could be replaced by an air compressor depending on particular requirements for particular embodiments.

Figure 12:
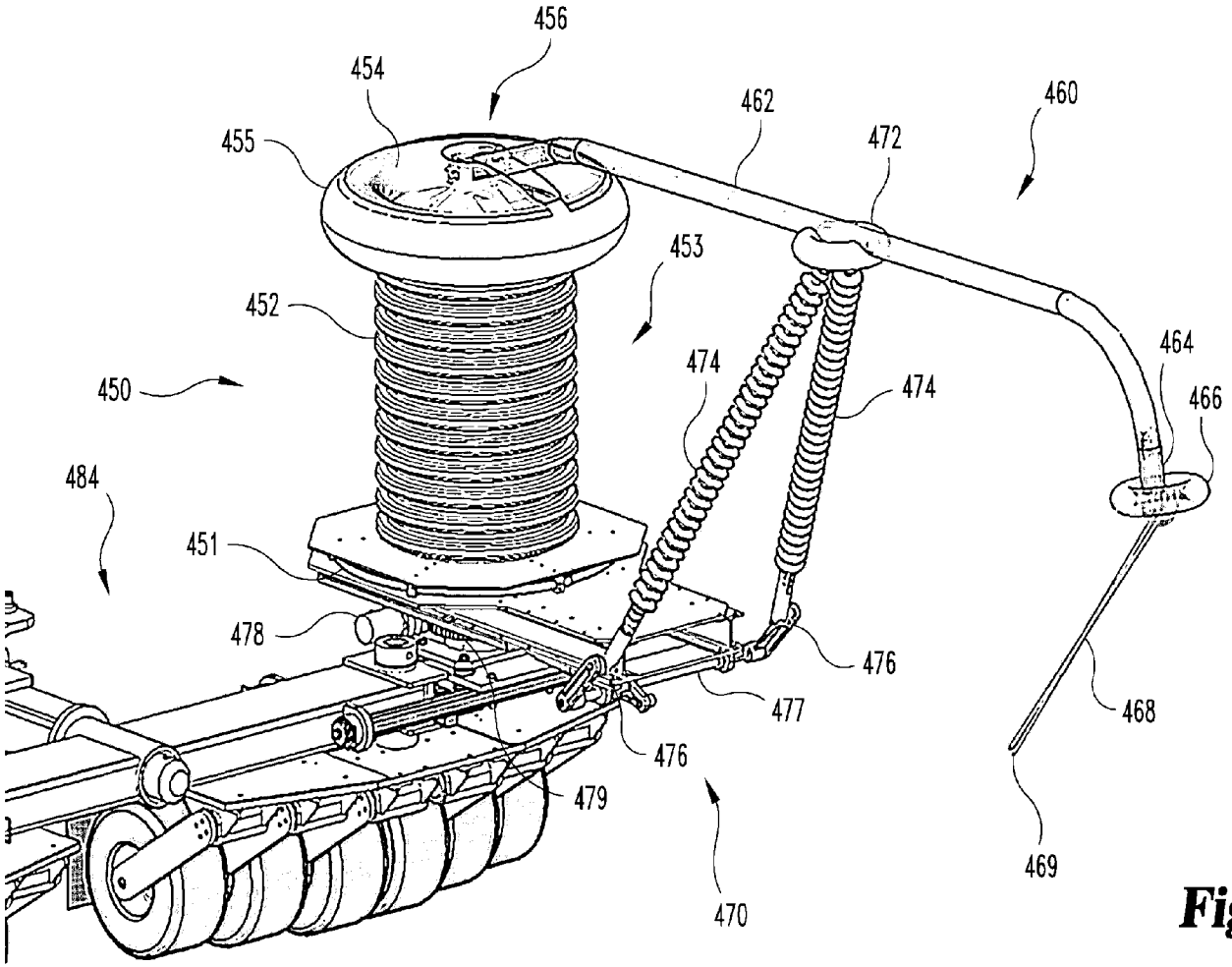
FIG. 12 is an isometric view of one embodiment of several components of system 400.

Turning now to FIG. 12, the front left portion of mine roller assembly 484 is illustrated in finer detail. Resonance transformer 450 includes primary coil 451, insulation 452, secondary coil 453 (under insulation 452), insulation 454 covering the top of toroidal capacitor 455 and coupling 456. In one embodiment, primary coil 451 has an approximate 36 inch outer diameter and a 20 inch inner diameter having 10-15 turns while a secondary coil 453 has an approximate 16 inch diameter and is approximately 36 inches long. Secondary coil 453 is covered by insulation 452. In one embodiment, insulation 452 comprises a dual wall polyethylene meter pit of a similar construction wall polyethylene drainage pipe.

Still referring to FIG. 12, emitter module 460 includes extension arm 462, motor 464, toroidal rotor 466, emitter probe 468 and emitter tip 469. Extension arm 462 is coupled to toroidal capacitor 455 at coupling 456. In one embodiment, coupling 456 comprises two posts connected to toroidal capacitor 454 having a rod inserted there between through extension arm 462 to form a pivot point. In one embodiment, extension arm 462 comprises 2¾ inch OD aluminum tube having a ⅛ inch thick wall. Motor 464 is at the end of extension arm 462. In one embodiment, motor 464 is a hydraulic motor driven by hydraulic tubing (not illustrated) that is run through extension arm 462 and resonance transformer module 450 from a source of hydraulic pressure located elsewhere on mine roller 480. In an alternate embodiment, motor 464 could be located near coupling 456 with a flexible coupling to rotor 466. In yet another embodiment, motor 464 could be located proximate to primary coil 451 with a flexible coupling to rotor 466 running through resonance transformer module 450 and extension arm 462. In other embodiments it is envisioned that motor 464 could be an air motor or an electric motor. However, in embodiments utilizing electric motor located as illustrated in FIG. 12, it would be essential to use substantial insulation between extension arm 462 and motor 464 to protect motor 464 from the substantial voltage that may be present in extension arm 462. Motor 464 is coupled to toroidal rotor 466 and emitter probe 468 having emitter tip 469 is coupled to toroidal rotor 466. In one embodiment, motor 464 is coupled off center to toroidal rotor 466 to such that a portion of the mass of toroidal rotor 466 offsets the mass of emitter probe 468. This is described in greater detail with regard to FIG. 13.

Position control module 470 includes cradle 472 supporting extension arm 462, supports 474, vertical height adjusters 476, rotary adjuster 478 and rotary gear 479. Supports 474 are coupled between vertical height adjusters 476 and cradle 472. In one embodiment, supports 474 are 4-foot long, standard insulation supports used in high power transmission. (Such standard insulation supports are traditionally used under tension to hang high voltage transmission lines from towers. However, they serve in compression in the illustrated embodiment without any additional modification.) Vertical height adjusters 476 operate through a cam about shaft 477 such that as shaft 477 rotates the relative position of vertical height adjusters 478 are adjusted. Shaft 477 is rotated through the action of a linear actuator (not illustrated), such a linear actuator could be hydraulic, pneumatic or electric as desired. Position control module 470 also includes rotary adjuster 478 acting on rotary gear 479 to rotate resonance transform module 450 and emitter module 460 about the center of resonance transformer module 450. Rotary adjuster 478, in the illustrated embodiment, drives a worm gear coupled to rotary gear 479, rotary adjuster 478 can be actuated by hydraulic, pneumatic or electric means as desired.

Figure 13:
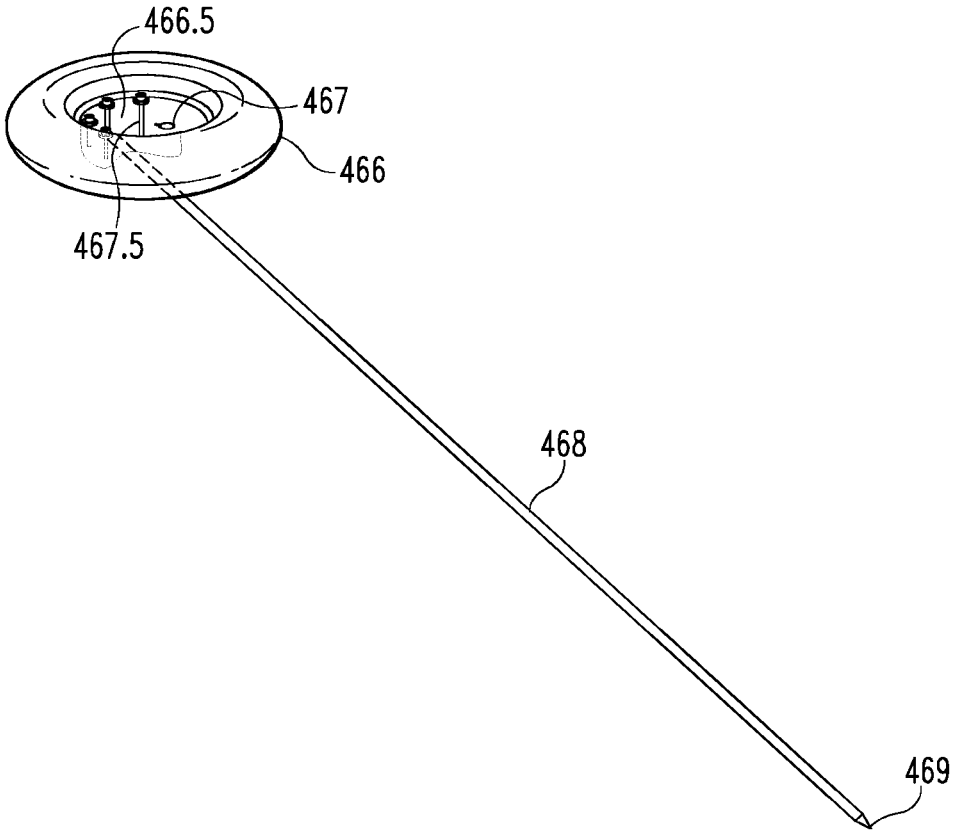
FIG. 13 is an isometric view of one embodiment of several components of system 400.

Turning now to FIG. 13, toroidal rotor 466 and emitter probe 468 are illustrated in greater detail. Specifically, toroidal rotor 466 includes counter weight 466.5, motor mount 467, center of mass 467.5, emitter probe 468 and emitter tip 469. As illustrated, emitter probe 468 is coupled to toroidal rotor 466 at counter weight 466.5. Motor mount 467 is located off center as compared to center of mass 467.5. The actual size of counter weight 466 and the degree that motor mount 467 is off set from center of mass 467.5 is dictated by the length, mass and angle of inclination of emitter probe 468. In one embodiment, the total mass of the components illustrated on FIG. 13 is balanced at motor mount 467 such that the assembly listed under FIG. 13 can rotate on motor 468 without any additional load due to an imbalanced configuration. Emitter probe 468 is illustrated as a ⅜ inch rod having a pointed emitter tip 469. However other embodiments are envisioned. In particular, the ⅜ inch rod could be replaced with a one-inch tube having an approximate 0.032 inch wall. In such an embodiment, emitter tip 469 can be replaced with a hollow tip coupled to the one-inch tube.

Figure 14:
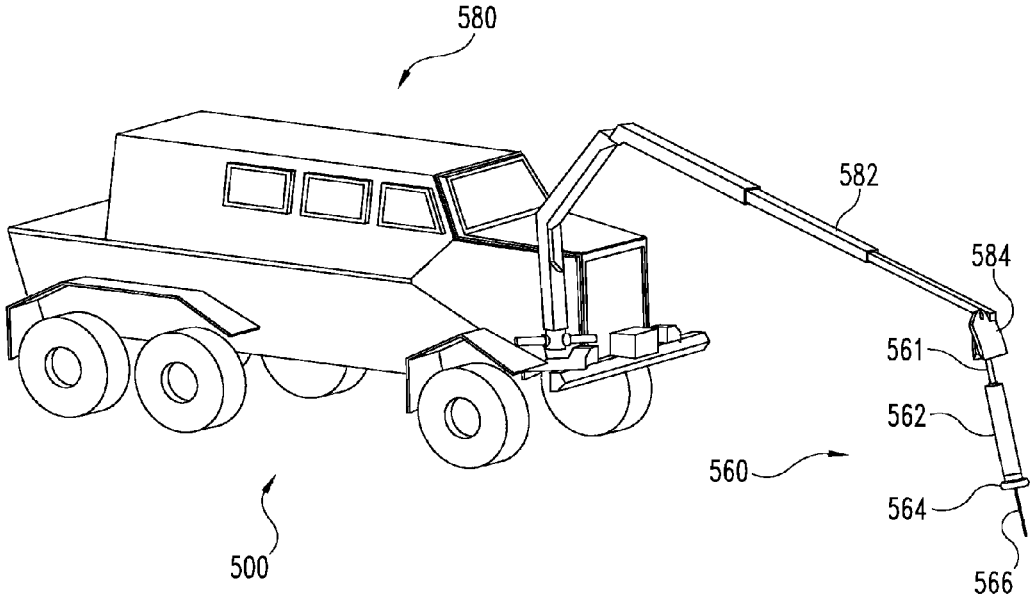
FIG. 14 is an isometric view of system 500.

Turning to FIG. 14, system 500 as illustrated includes vehicle 580, articulated arm 582, claw 584, and emitter module 560. Vehicle 584 in the illustrated embodiment is a Buffalo type mine disposal unit which is currently in use by the U.S. military for investigation and disposal of mines and IEDs. Buffalo 580 includes articulated arm 582 and claw 584. In the illustrated embodiment claw 584 is grasping grip 561 on emitter module 560. Emitter module 560 includes coil 562, toroidal capacitor 564 and emitter probe 566.

The embodiment of the emitter module 560 illustrated in FIG. 14 is removable from claw 584 by manipulation of claw 584 and emitter module 560 is intended to be deployed by the crew of 580 as desired for applications in which electrical discharge is not desired, emitter probe 560 could be stowed elsewhere on vehicle 580 (not illustrated). Coil 562 of emitter probe 560 includes a primary and secondary coil electromagnetically coupled together. The illustrated embodiment while not shown, the primary coil is a helical type that could be either butted near the secondary coil or the secondary coil could overlap inside or outside of the helical primary coil as is know in the art.

The power generation apparatus for system 500 is not specifically illustrated, however they could be located on vehicle 582 where convenient. Coil 560 could be coupled to such power generation equipment by a flexible wire permitting deployment of emitter module 560 remote from vehicle 580 including articulated arm 582 and claw 584. In such an embodiment where emitter module 560 is to be remotely deployed, emitter module 560 could include appropriate support structures such as tripod or other support devices to permit the positioning of emitter module 560 and emitter probe 566 where desired to interrogate a particular target with an electric discharge while vehicle 580 could then be remotely located exposing only emitter module 560 to potential destructive effects of a detonated mine or IED.

Figure 15:
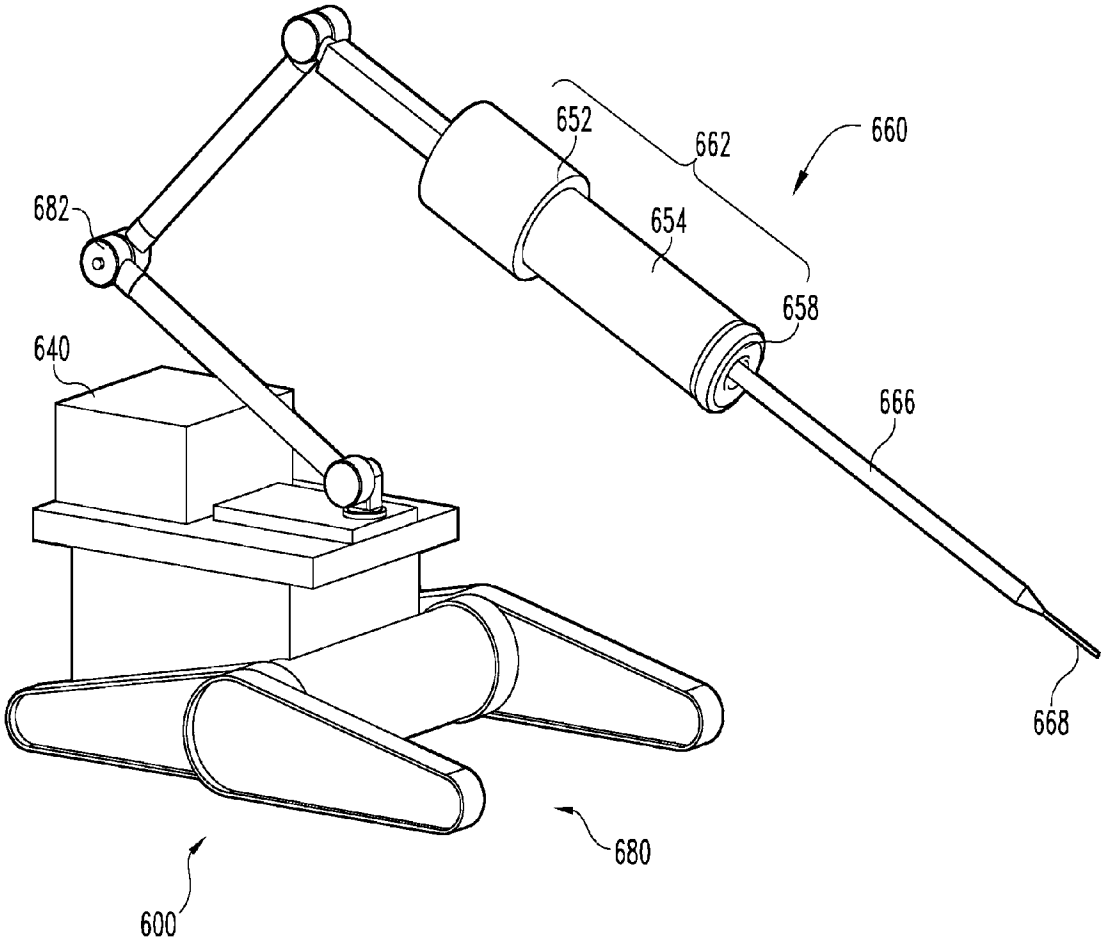
FIG. 15 is an isometric view of system 600.

Turning now to FIG. 15, system 600 is illustrated. System 600 comprises a remote control application of the discharge system described herein and includes remote control vehicle 680 having an articulated arm 682 mounting emitter module 660. Emitter module 660 includes resident transformer 662, including primary coil 652 and secondary coil 654, toroidal capacitor 658 and emitter probe 666 having tip 668. System 600 also includes power module 640 mounted on vehicle 680 behind articulated arm 682. Power module 640 may include a power source and power switching circuit to supply energy to emitter module 660 and resonance transformer 662. The power source in power module 640 may be a DC battery source and a power switching circuit may be solid state switching unit as described with respect to system 200 above. Vehicle 680 is remote controlled permitting an operator to be located remotely from vehicle 680 and in particular tip 668 when an electrical discharge is initiated.

FIGS. 5-15, as described above, detail several possible embodiments of systems 100 and 200. Additional embodiments have been considered that are not illustrated herein. For example, FIGS. 5-15 each include an emitter structure coupled to a toroidal capacitor, such an emitter structure is unnecessary. For example, electrode 384 could be omitted from discharge assembly 310. In such an embodiment, electrical discharges would occur randomly from the illustrated toroidal capacitor. Another embodiment that is not illustrated herein is utilizing an extremely long discharge electrode. For example, extension arms 462 could in system 400 could be made much longer with a pointed or rounded end to provide a different means to locate the electrical discharges. A similar embodiment could be utilized in systems 500 and/or 600 to extend the length of the emitter probe to further remove vehicles 580 and/or 680 from the vicinity of any electrical discharge and possible IED or mine detonation.

Figure 16:
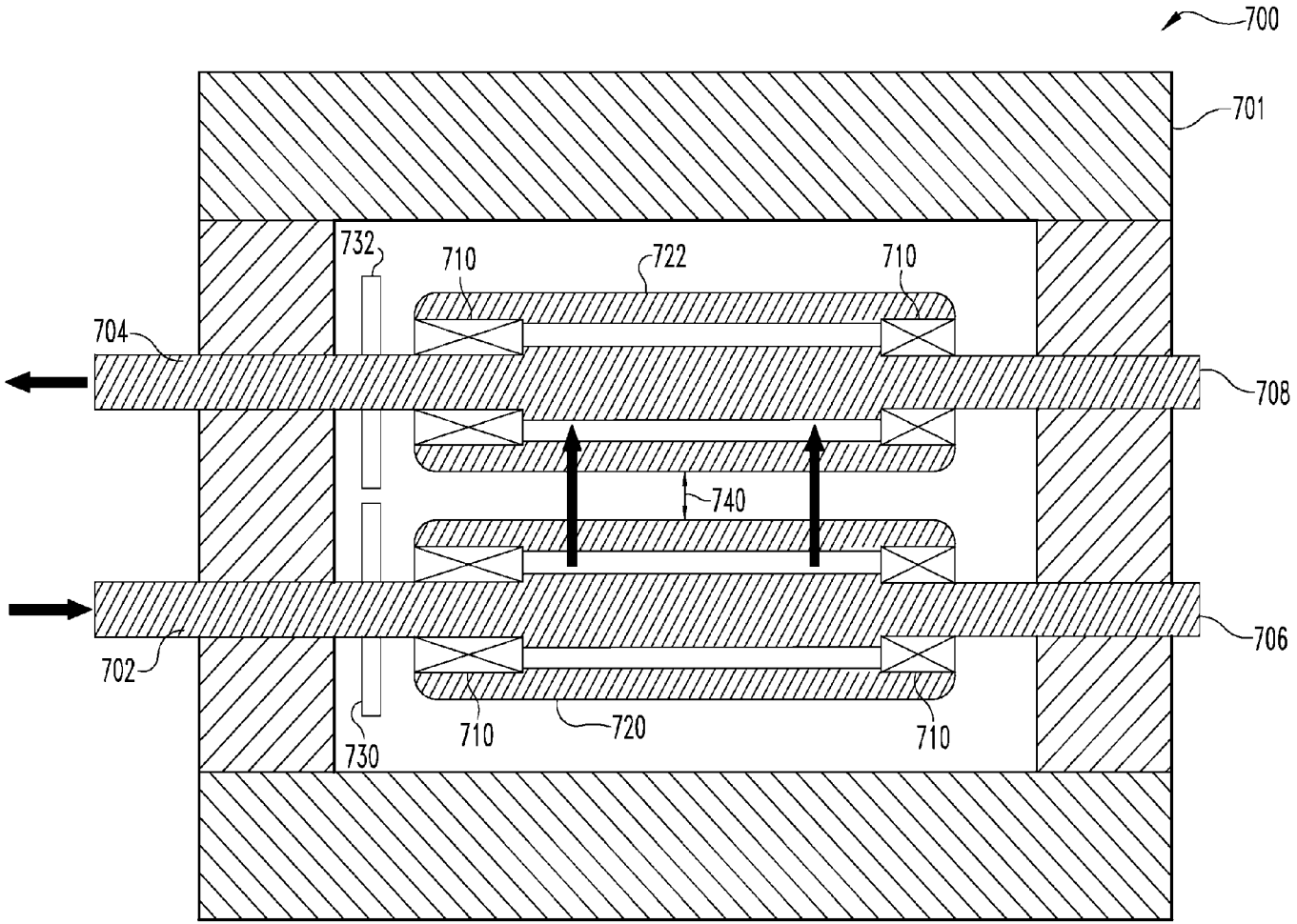
FIG. 16 is a top down view of a spark gap apparatus.
Figure 17:
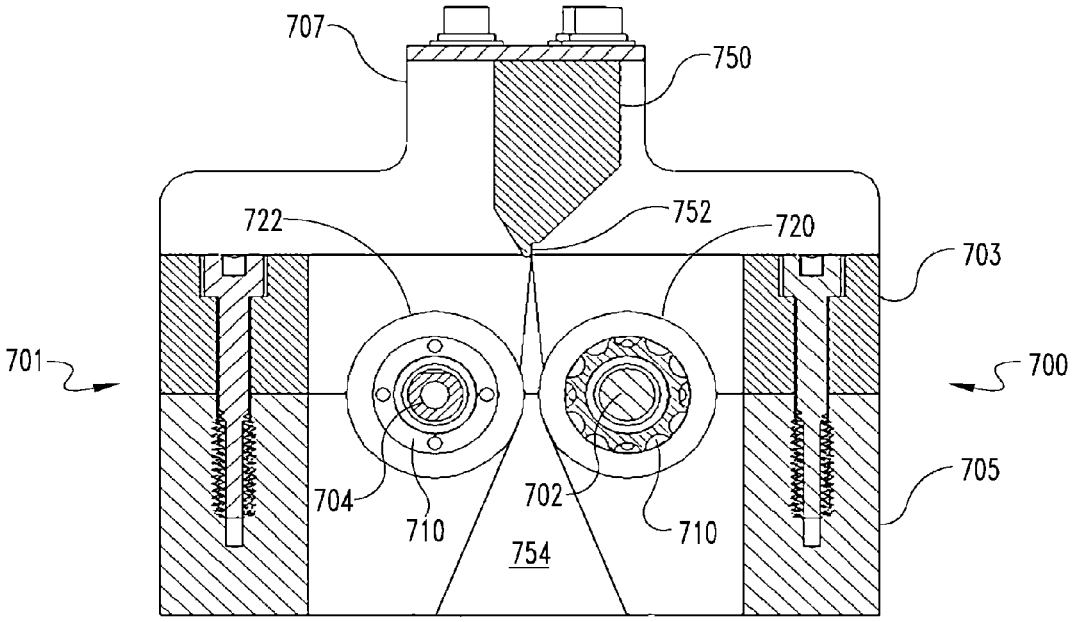
FIG. 17 is a side view of the apparatus of FIG. 16.

Turning now to FIGS. 16-17, an embodiment of spark gap 142 is illustrated as assembly 700. Specifically regarding FIG. 16, assembly 700 includes casing 701, shafts 702 and 704, ends 706 and 708 with bearings 710 mounting rollers 720 and 722 on shafts 702 and 704. Shafts 702 and 704 include pulleys 730 and 732 and rollers 720 and 722 are set apart by roller gap 740. The arrows illustrated on FIG. 16 depict current flow from shaft 702 to shaft 704 through roller gap 740, roller 720 and 722 and bearings 710. The illustrated rollers in FIGS. 16-17 have an approximate 1.5 inch diameter and 5 inch length.

Turning now to FIG. 17, assembly 700 is illustrated as a side view. As shown in FIG. 17, assembly 700 also includes top support 703, bottom support 705, bracket 707 mounting air knife 750 having air output 752 which generate air flow 754 between rollers 720 and 722.

As depicted in FIGS. 16-17, rollers 720 and 722 are oriented in parallel of each other to produce a uniform roller gap 740. Rollers 720 and 722 move about shaft 702 and 704 on internal bearings 710. Shaft 702 and 704 are electrically connected to a pulse circuit such as that included in system 100. Rollers 720 and 722 serve as the spark gap electrodes. Roller gap 740 is fixed such that the electrical conduction and hence breakdown voltage between rollers 720 and 722 occurs at a desired applied high voltage. A flow of air is supplied through air knife 750 perpendicular to roller gap 740 to electrically quench roller gap 740 after each discharge. Such electrical quenching primarily occurs due to removable of ionized air generated by a preceding spark but air flow 740 also serves to cool off rollers 720 and 722. Rollers 720 and 722 are rotated during operation by belt (not illustrated) driving pulleys 730 and 732. In alternate embodiments, pulleys 730 and 732 can use timing belts or o-ring belts depending on the degree of accuracy and synchronization desired between rotation of rollers 720 and 722. In yet other embodiments, pulleys 730 and 732 may be omitted, in such embodiments, pulleys 730 and 732 may be replaced with a turbine wheel that utilizes air flow 754 to power rotation of rollers 720 and 722 and yet in other embodiments, rollers 720 and 722 may be left to rotate in air flow 754, unaided in any other way.

Apparatus 700 may also include additional roller pairs with associated roller gaps electrically added in series to distribute generated heat over even more surface area. In such embodiment the gap spacing for each opposing roller pair may need to be reduced such that the total cumulative spacing for the required breakdown voltage remains the same. Heat production in each roller gap is proportional to the gap spacing. Gap spacing establishes the repetition rate of discharges as well as the average power delivered by an individual discharge. In some embodiments, it is desirable for this to be constant and in such embodiments, rollers 720 and 722 can be concentric about shaft 702 and 704. In other embodiments it may be advantageous for either or both of rollers 720 and 722 to be non-concentric such that roller gap 740 varies to some agree with the revolution of rollers 720 and/or 722. Such embodiments may advantageously provide a combination of high power discharges that are separated by more rapid, lower power discharges to provide varying discharge characteristics as will be discussed further herein.

The outer surface of roller 720 and 722 may be constructed of several materials. In one embodiment, pure tungsten or tungsten alloy may be utilized. In other embodiments, brass may be used. Other electrically conducted materials may be fabricated from brass or copper or other suitably conductive material wherein the non-conductive components are constructed of phenolic in one embodiment. In other embodiments may utilize other heat and discharge resistant materials as desired.

The systems described herein can be used for a variety of mine and IED clearing functions. For example, system 400 is configured to permit scanning operations where illustrated mine roller 480 may traverse a section of ground, for example a road, scanning for possible mines or IEDs utilizing electrical discharges spread over a large area. In such an embodiment, it is desirable for each discharge to have sufficient power to reliably detonate a mine or IED, yet this is balanced against the desire to rapidly scan a road or other ground area as quickly as possible with a multitude of discharges. Also regarding such an embodiment, it has been found that the rotating emission point provided by system 400 may improve scanning performance by urging subsequent electrical discharges to various targets on the ground.

Figure 18:
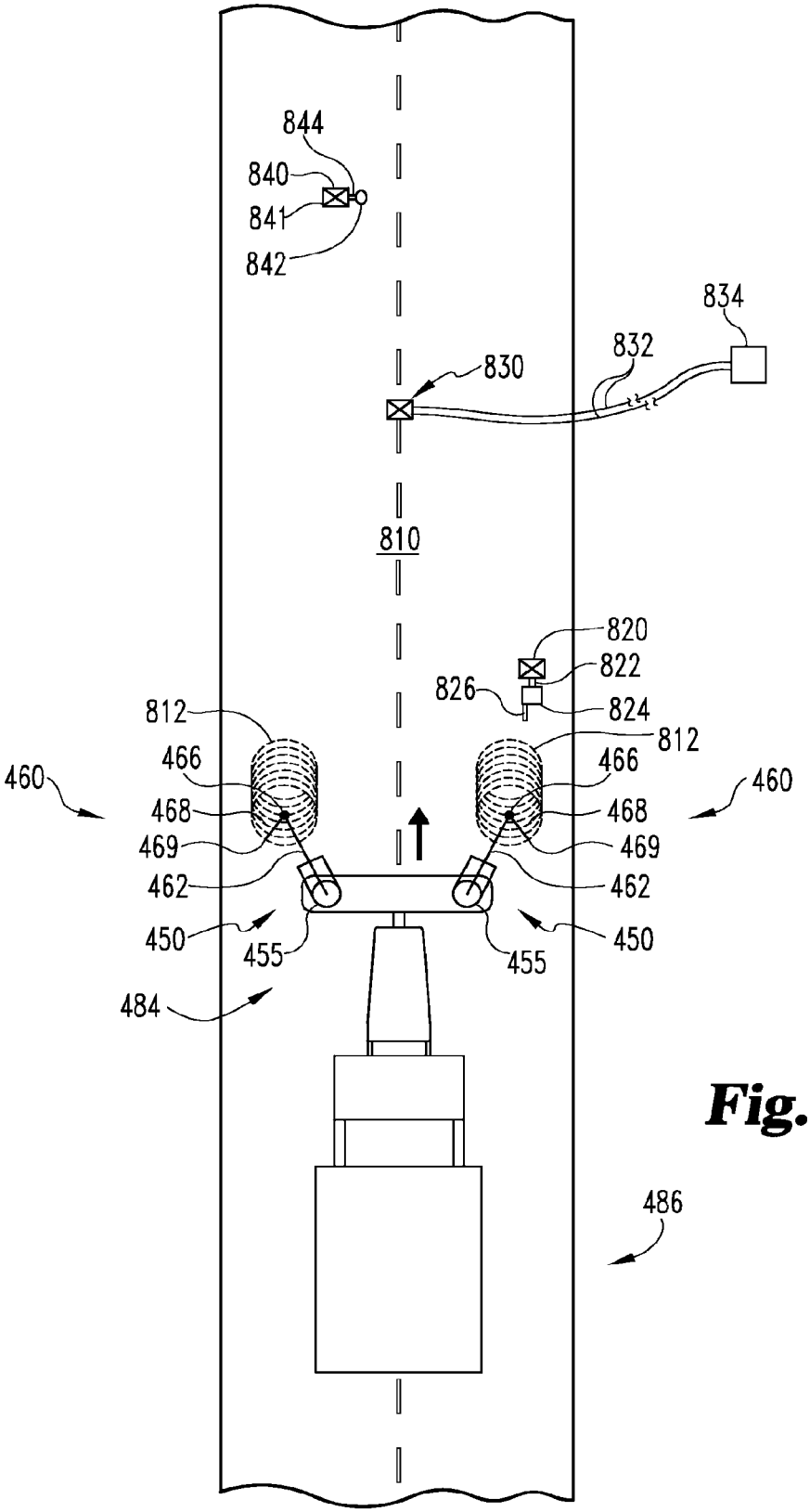
FIG. 18 is an illustration of the application of one embodiment of system 400.

Turning to FIG. 18, a specific example of one scanning application of roadway 810 is illustrated utilizing an embodiment of system 400. In particular, mounting dual electrical discharge units on vehicle 486 and mine roller assembly 484. System 400 is not illustrated in complete detail for clarity; however, the following components are illustrated to provide reference. Particularly, resonance transformer modules 450 including toroidal capacitor 455, emitter modules 460 including extension arms 462, toroidal rotors 466, emitter probes 468 including tips 469. Vehicle 486 and mine roller 484 are moving forward as indicated by the arrow such that as emitter tip 469 rotates about toroidal rotor 466 generating emitter tip scan pattern 812. In one embodiment, emitter tip scan pattern 812 resembles a pattern that may be created by a spirograph as the rotation of emitter tip 469 is combined with linear motion in the direction of the arrow as vehicle 486 traverses roadway 810.

For illustrative purposes, FIG. 18 includes several interrogation targets located on or near roadway 810 including IED 820 having command wires 822 connected to radio detonator 824 including antenna 826 and IED 830 including command wires 832 leading to detonator 834 and mine 840 including outer casing 841, wiring 844 connected to pressure sensor 842. For each example provided, methods that electrical discharges could detonate IEDs 820 or 830 or mine 840 are described as follows. As vehicle 846 traverses roadway 810, emitter tip 469 may move into proximity to IED 820 and the components associated therewith. As electrical discharges emit from emitter tip 469, they will seek the path of least resistance to ground. When in proximity with metallic devices such antenna 826, radio detonator 824, command wires 822 and possibly IED 820, there is a high likelihood of such metal components being included in the path of least resistance to ground, thereby attracting electrical discharge in the vicinity towards such objects. In particular, items such as antenna 826 may be particularly susceptible to attracting electrical discharges as such an antenna may be located above the ground surface or located only below a small amount of earth. As components 820, 822, 824 and 826 are coupled together at least through command wires 822 an electrical discharge striking any of the components has a good likelihood of being conducted to IED 820. Wherein the electrical discharge connected to a portion of the bridge wire, electric flow or electric match contained therein, then conduction either through the command wires or through the initiation system to some other part of IED 820 has the propensity to initiate detonation. This can occur by passing sufficient current through the initiation system or by creating an electric discharge from the command wire to the outside of the initiator while generating sufficient heat to initiate detonation of the IED or at least burn the materials necessary to initiate a detonation of the IED.

With regard to IED 830, IED 820 and particularly command wires 822 will be within the emitter tip scan pattern as system 400 traverses roadway 810. Command wires 832 are beneath the illustrated emitter tip scan pattern while IED 830 would be missed by direct coverage by the emitter tip scan pattern; however, any electric discharge that strikes on or near command wires 832 has a good probability of burning through any insulation covering command wires 852 (as little as 300V could suffice to break down insulation on some command wires) to conduct an electric discharge to IED 830 that could potentially detonate IED 830 as described above. Referring to mine 840, it is first noted that mine 840 is not located directly within the emitter tip scan pattern illustrated. However, there is still a likelihood of an electric discharge reaching mine 840 as electric discharges are not limited directly to vertical strikes and as stated above they will seek out the lowest resistance path to ground. Thus, there is still a possibility of electric discharges reaching beyond the direct emitter scan pattern illustrated. In any event, if an electric discharge does not detonate mine 840 as described above, then mine roller assembly 840 will pass directly over pressure sensor 842 thereby detonating mine 840.

Regarding specific operating parameters for emitter module 840 and/or discharge assembly 310, several parameters have been developed for basic scanning operations. In one embodiment, tip 486 is located between 8 inches and 40 inches above the ground. In another embodiment, emitter tip 469 is located approximately 27 inches above the ground. The height above the ground of tip 469 directly affects the voltage reached in toroidal capacitor 455 such that if emitter tip 469 is located closer to ground then discharge will occur prior to high potential being accumulated. Conversely, if emitter tip 469 is too high above the ground, then the required potential to initiate a discharge to ground may require additional charging time to reach, thus reducing the strike frequency. The systems described herein have been found capable of generating upwards of 750 kV when emitter tip 469 is located approximately 8 feet above ground. Comparatively, with emitter tip located approximately 27 inches above ground the average potential reached is approximately 400 kV. Accordingly, system performance can be controlled, at least in part, by the elevation of emitter tip 469.

As mentioned above, as little as 300 V can break down some insulators used on command wires. Standardized testing has established that, while blasting caps are shielded from static discharges, some blasting caps are susceptible to detonation by as little as a 10 kV while 30 kV is generally sufficient to overcome any shielded blasting cap. An example of blasting cap shielding is surrounding the bridgewire, foil or electric match with a small air gap. However, when a blasting cap is energized with sufficient voltage, it is possible for an arc to occur in the vicinity of the bridgewire, foil or electric match. If the arc has sufficient energy, then the blasting cap may detonate. If there is not sufficient energy to generate sufficient heat, then the blasting cap would likely be unaffected by the electric discharge. Sufficient heat can also be delivered by a series of discharges, provided they occur quickly enough so that the heat accumulates with subsequent discharges.

The lower threshold of the amount of energy required to detonate a blasting cap has not been defined, however, testing has established several operating ranges that have proven to provide electric discharges with sufficient energy to detonate blasting caps as follows. Using a resonator coil with a static gap system similar to system 100 described above, operating between 50 to 1,500 pulses per second at 5 to 40 joules per pulse has been found sufficient for scanning operations. Conversely, using a resonator coil with a solid state control system similar to system 200 described above, 50 to 20,000 pulses per second at 1 to 0.005 joules per pulse has been found sufficient for scanning operations. Finally, non-resonant transformers have been used with discharge rates between 0.1 and 120 pulses per second with between 1 and 200 joules per pulse.

The duration of each pulse also affects the amount of energy delivered with each pulse. In one embodiment utilizing system 100 has a pulse duration of approximately 50 microseconds. Other embodiments utilizing system 100 have pulse durations between 30-100 microseconds.

While single emitter tips have been disclosed herein, it is possible to use multiple emitter tips. For example, two emitter tips located 180° opposite of each other. Such configurations may balance the emitter mass probe about the point of evolution. An alternative to such a multi-emitter configuration is to increase the rotation speed of emitter probe 468 to achieve similar ground coverage as a slower spinning dual emitter configuration. Emitter probe 468 can vary in length. In one embodiment between 12 inches and 36 inches, shorter emitter probes allow for higher angular rotation speeds and a more concentrated strike rate in the particular area of coverage. This potentially results in a higher rate of linear travel if operated from a mobile platform. However, the field of coverage would be reduced. Other embodiments utilizing longer probe lengths, for example 36 inches, require slower rotational speeds to maintain a similar strike rate per area. Such longer probes also result in slower linear rates of travel if operating from a mobile platform. However, the coverage field is substantially increased in width. Embodiments utilizing probes of approximately 24 inches in length are comparatively more balanced in terms of rotational speed and rate of linear travel if operated from multiple platforms providing an acceptable balance between scanning speed and scanning area.

Emitter probes 468 are generally angled between 40° land 50°. Smaller angles, such an emitter probe near horizontal to earth, may result in discharges occurring in non-uniform pattern along length of the rod. Similarly, the shape of emitter tip 469 effects the predictability of the discharge pattern. Use of spherical probe tips is found to cause sporadic discharge activity over a large portion of the sphere facing earth with an effective discharge strike pattern. However, the addition of spheres does complicate the overall assembly by the added size and weight on the end of emitter probe 468. On the other hand, use of a pointed tip for emitter tip 469 resulted in a concentration of the electric field at the point of tip. The use of a pointed tip resulted in effective discharge strike patterns and predictable discharge activity.

The ability for system 400 to rapidly scan a large area while locating and neutralizing IEDs can be optimized through manipulation of several factors. Emitter discharge rate in combination with the potential of each discharge establishes an average strike power. These are functions of coil design and the control circuit method. In embodiments utilizing solid state controls the discharge rate is established by electronic circuit timing. Conversely in embodiments controlled by spark gap units, the discharge rate is determined primarily by the input power and the frequency, the size and charge of the capacitor and spark gap spacing. For embodiments utilizing rotary spark gaps the discharge rate is governed primarily by the rotary gap speed and the number of discharge gaps. Methods can be employed to increase the average strike power including increasing the frequency of the AC supply, for example, to 400 Hz. Alternatively, a polyphase or multiple phase power source could be utilized that would increase the discharge rate without sacrificing individual discharge energy thereby increasing the average delivered output by the number of phases used. Individual discharge energy for scanning operations must be sufficient to break down or ionize ambient air and promote an arc of sufficient strength, either alone or in combination, to detonate the IED or mine target.

Figure 19:
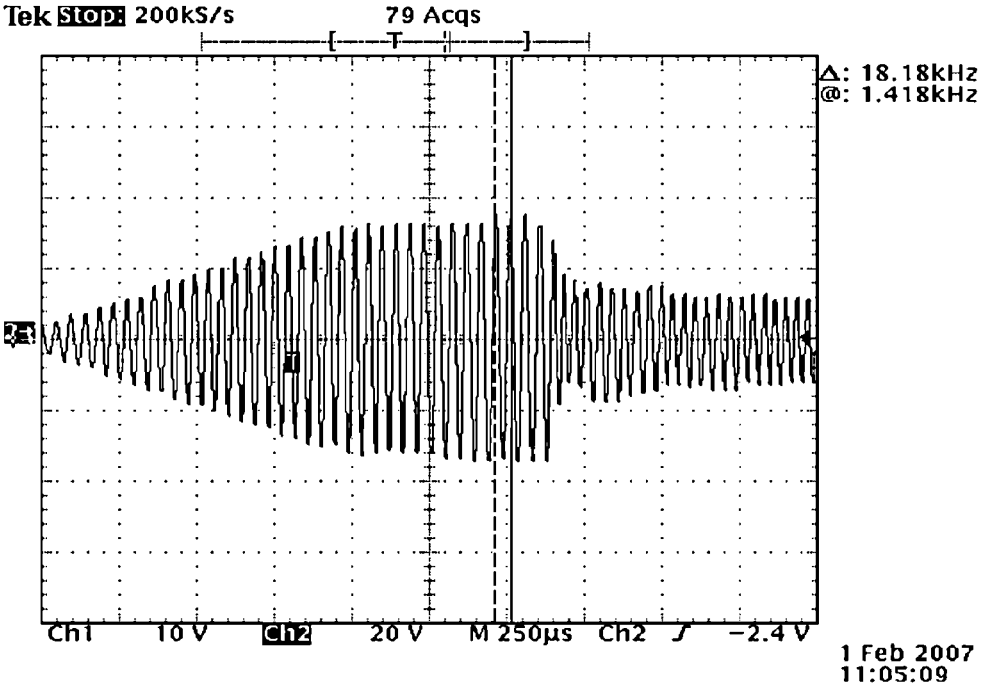
FIG. 19 is a plot of voltage versus time for a system utilizing solid state controls.
Figure 20:
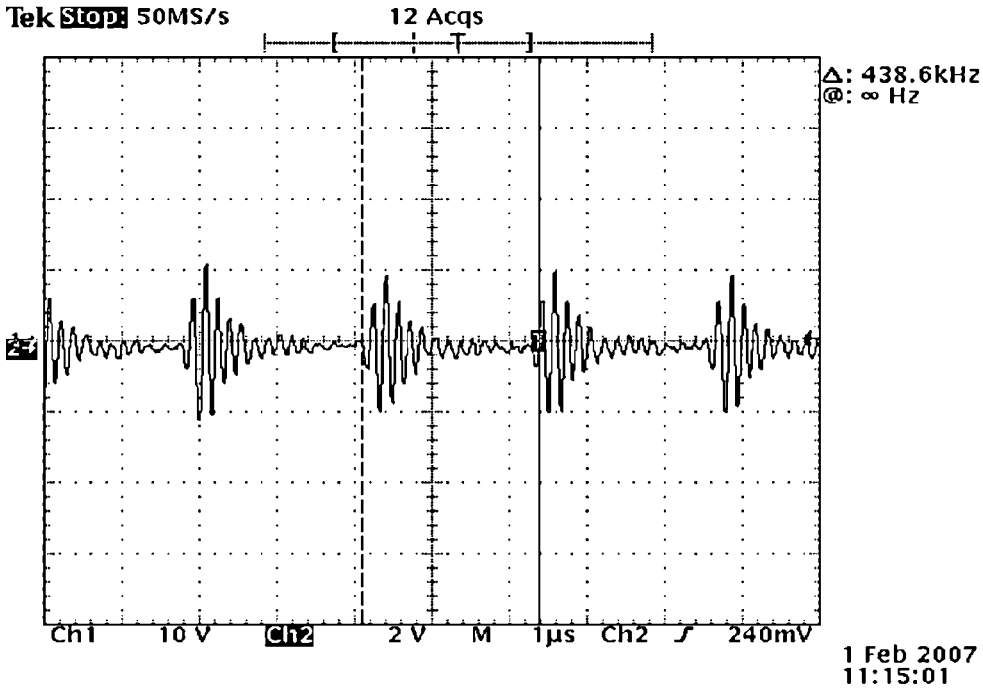
FIG. 20 is a plot of voltage versus time for a system utilizing solid state controls.
Figure 21:
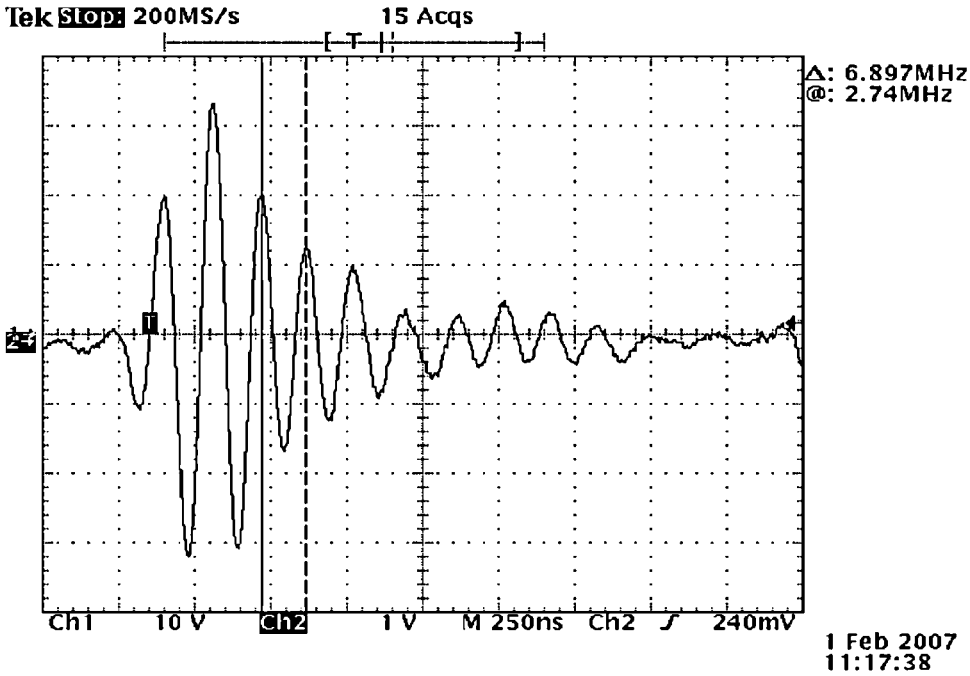
FIG. 21 is a plot of voltage versus time for a system utilizing solid state controls.
Figure 22:
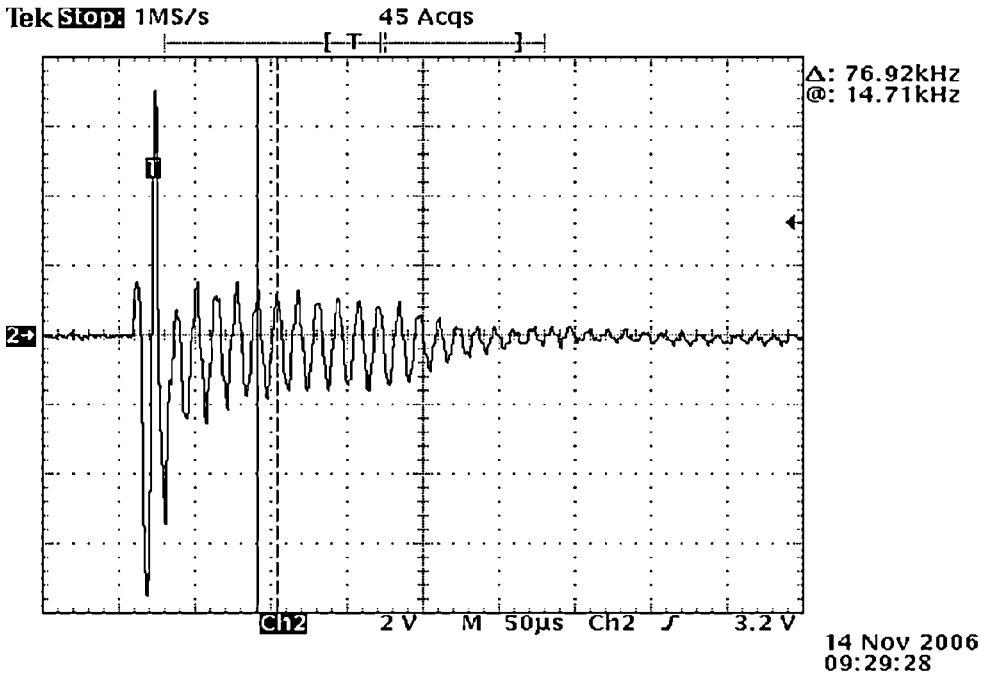
FIG. 22 is a plot of voltage versus time for a system utilizing spark gap controls.
Figure 23:
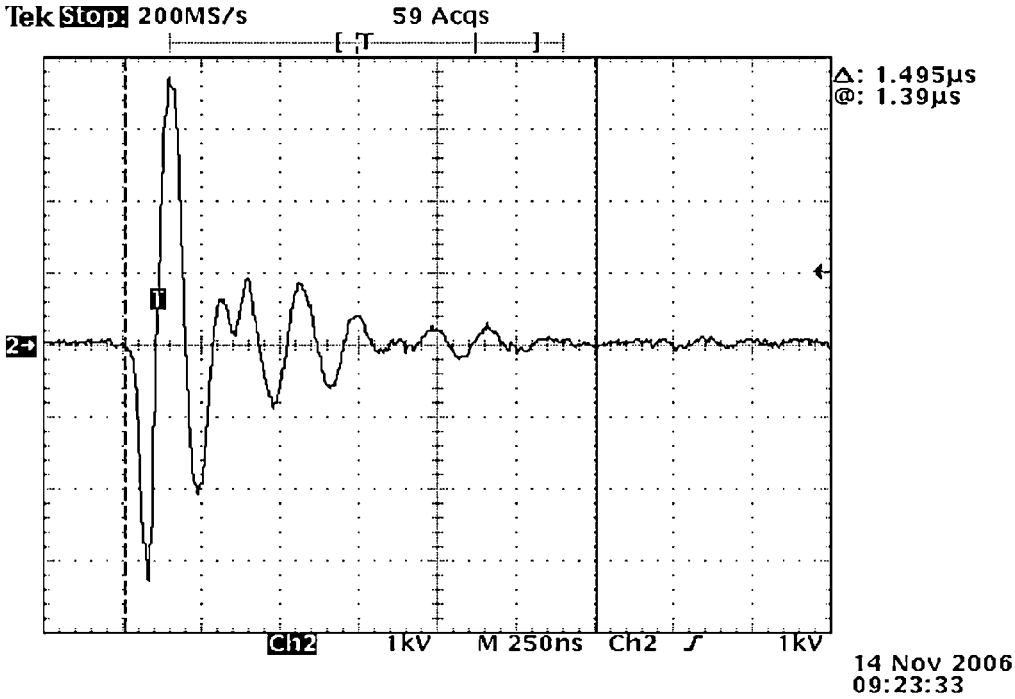
FIG. 23 is a plot of voltage versus time for a system utilizing spark gap controls.

Turning now to FIGS. 19-23, examples are provided of high voltage wave forms plotted versus time. FIGS. 19-21 are examples of high voltage output pulses utilizing solid state controls while FIGS. 22-23 are examples of high voltage output pulses driven by spark gap controlled coils. Methods can be used to mechanically manipulate spark gaps to produce non-uniform discharge energies. For example, using a rotary spark gap mechanism where rotating electrodes are spaced unequally results in varying energy charged times; therefore, varying discharge energies producing a combination of high frequency, lower energy discharges with low frequency maximum energy pulse.

In other embodiments, a scanning operation is not contemplated but interrogation of a suspected mine or IED site is desired. Such cases, capacity to rapidly produce a multitude of discharges may not be needed, i.e., it may be sufficient to produce a single emission having sufficient energy to disable or destroy a device being interrogated.

While the disclosure has been illustrated and described in detail in the drawings and foregoing description, the same is to be considered as illustrative and not restrictive in character, it being understood that only the preferred embodiments have been shown and described and that all changes and modifications that come within the spirit of the disclosure are desired to be protected.

What is claimed is:

1. A system for detonating a buried explosive device, the system comprising:

a vehicle;

a boom arm on the vehicle;

a generator that generates an electric potential, wherein the generator is carried by the vehicle; and an emitter electrically coupled to the generator and carried by the boom arm, where the emitter is constructed and arranged to discharge the electric potential as an electric discharge into the explosive device, wherein the electric discharge includes at least 5 joules of energy, wherein the emitter discharges through a substantially constant point and wherein the boom arm is constructed and arranged to position the emitter away from the vehicle and the generator.

2. The system of claim 1, further comprising a resonance transformer electrically coupled between the generator and the emitter, wherein the resonance transformer increases the electric potential.

3. The system of claim 2, wherein the resonance transformer increases the electric potential above 30,000 volts.

4. The system of claim 2, wherein the resonance transformer produces a pulsed electric potential that is discharged by the emitter as a pulsed electric discharge.

5. The system of claim 4, wherein the pulsed electric discharge produced by the resonance transformer has a pulse duration between about thirty and about one hundred microseconds.

6. The system of claim 2, further comprising a high voltage transformer electrically coupled between the generator and the resonance transformer.

7. The system of claim 6, wherein the high voltage transformer increased the electric potential to approximately 14.4 kilovolts.

8. The system of claim 1, wherein the generator produces time varying energy.

9. The system of claim 8, wherein the time varying energy is Alternating Current electric energy.

10. The system of claim 1, wherein the vehicle further comprises armor.

11. The system of claim 1, wherein the vehicle further comprises controls for local operation of the vehicle.

12. The system of claim 1, wherein the vehicle is configured with remotely operable controls.

13. The system of claim 1, wherein the buried explosive is selected from a group consisting of: a land mine and an improvised explosive device.

14. The system of claim 1, wherein the system is constructed and arranged to move the electrode with the vehicle while discharging electric discharges through the emitter.

15. The system of claim 1, wherein the system is constructed and arranged to pulse the electric discharge.

16. The system of claim 15, wherein the electric discharge has a pulse duration between about thirty and about one hundred microseconds.

17. The system of claim 1, further comprising a Tesla coil electrically coupled between the generator and the emitter.

18. The system of claim 1, wherein the system is constructed and arranged to generate an electric field around the emitter that promotes electrical discharge between the emitter and the buried explosive device.

19. The system of claim 1, wherein the electrical potential generated by the generator is sufficient to create a dielectric breakdown of air between the emitter and the earth.

20. The system of claim 1, wherein the emitter defines a shape that is operable to concentrate an electric field at the substantially constant point.

* * * * *

UNITED STATES PATENT AND TRADEMARK OFFICE

CERTIFICATE OF CORRECTION

PATENT NO. : 8,561,515 B1
APPLICATION NO. : 13/721974
DATED : October 22, 2013
INVENTOR(S) : Peter V. Bitar et al.

It is certified that error appears in the above-identified patent and that said Letters Patent is hereby corrected as shown below:

In the Specification

In column 12, line 41, replace “agree” with --degree--
In column 15, line 25, replace “land” with --and--

Signed and Sealed this
Tenth Day of December, 2013

Margaret A. Focarino

Margaret A. Focarino
*Commissioner for Patents of the United States Patent and Trademark Office*